US008839861B2

(12) United States Patent
Yeh et al.

(10) Patent No.: US 8,839,861 B2
(45) Date of Patent: Sep. 23, 2014

(54) SYSTEMS AND METHODS FOR PROVIDING ZONAL ISOLATION IN WELLS

(75) Inventors: Charles S. Yeh, Spring, TX (US); Michael D. Barry, The Woodlands, TX (US); Michael T. Hecker, Tomball, TX (US); David C. Haeberle, Cypress, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 297 days.

(21) Appl. No.: 13/202,513

(22) PCT Filed: Mar. 12, 2010

(86) PCT No.: PCT/US2010/027199

§ 371 (c)(1),
(2), (4) Date: Aug. 19, 2011

(87) PCT Pub. No.: WO2010/120419

PCT Pub. Date: Oct. 21, 2010

(65) Prior Publication Data

US 2012/0018153 A1 Jan. 26, 2012

Related U.S. Application Data

(60) Provisional application No. 61/169,160, filed on Apr. 14, 2009.

(51) Int. Cl.
*E21B 43/04* (2006.01)

(52) U.S. Cl.
CPC ..... *E21B 43/04* (2013.01)
USPC ..... 166/278; 166/51

(58) Field of Classification Search
USPC ..... 166/278, 51
See application file for complete search history.

(56) References Cited

U.S. PATENT DOCUMENTS

| | | | |
|---|---|---|---|
| 3,747,682 | A | 7/1973 | Taylor |
| 3,866,681 | A | 2/1975 | Shirley |
| 4,945,991 | A | 8/1990 | Jones |
| 5,082,052 | A | 1/1992 | Jones et al. |
| 5,113,935 | A | 5/1992 | Jones et al. |
| 5,161,613 | A | 11/1992 | Jones |
| 5,161,618 | A | 11/1992 | Jones et al. |

(Continued)

OTHER PUBLICATIONS

Barry, M. D. et al., "Openhole Gravel Packing with Zonal Isolation", SPE 110460, Nov. 11-14, 2007, 2007 SPE Annual Technical Conference, pp. 1-10, Anahein, CA.

(Continued)

*Primary Examiner* — Cathleen Hutchins
(74) *Attorney, Agent, or Firm* — ExxonMobil Upstream Research Company—Law Department

(57) ABSTRACT

Systems and methods for providing zonal isolation in a hydrocarbon well include or utilize a tubular assembly having an upstream manifold, a gravel packing conduit, a transport conduit, a leak-off conduit, and a downstream flow path. The tubular assembly is adapted to receive a gravel-laden slurry and to direct at least a portion of the same to the gravel packing conduit. The gravel-laden slurry exiting the gravel packing conduit packs the annulus between the tubular assembly and the wellbore by dehydrating at least in part through the leak-off conduit. The leak-off conduit is further gravel-packed by the gravel-laden slurry received by the tubular assembly. The leak-off conduit is dehydrated through a flow control valve. Together, the gravel packed annulus and the gravel packed leak-off conduit provide a gravel-based zonal isolation system.

36 Claims, 7 Drawing Sheets

(56) References Cited

U.S. PATENT DOCUMENTS

| | | | |
|---|---|---|---|
| 5,333,688 | A | 8/1994 | Jones et al. |
| 5,333,689 | A | 8/1994 | Jones et al. |
| 5,396,954 | A | 3/1995 | Brooks |
| 5,417,284 | A | 5/1995 | Jones |
| 5,419,394 | A | 5/1995 | Jones |
| 5,435,391 | A | 7/1995 | Jones |
| 5,515,915 | A | 5/1996 | Jones et al. |
| 5,560,427 | A | 10/1996 | Jones |
| 5,588,487 | A | 12/1996 | Bryant |
| 5,690,175 | A | 11/1997 | Jones |
| 5,842,516 | A | 12/1998 | Jones |
| 5,848,645 | A | 12/1998 | Jones |
| 5,868,200 | A | 2/1999 | Bryant et al. |
| 5,890,533 | A | 4/1999 | Jones |
| 5,909,774 | A | 6/1999 | Griffith et al. |
| 6,059,032 | A | 5/2000 | Jones |
| 6,220,345 | B1 | 4/2001 | Jones et al. |
| 6,227,303 | B1 | 5/2001 | Jones |
| 6,318,465 | B1 | 11/2001 | Coon et al. |
| 6,464,007 | B1 | 10/2002 | Jones |
| 6,513,599 | B1 | 2/2003 | Bixenman et al. |
| 6,520,254 | B2 | 2/2003 | Hurst et al. |
| 6,575,251 | B2 | 6/2003 | Watson et al. |
| 6,588,506 | B2 | 7/2003 | Jones |
| 6,601,646 | B2 | 8/2003 | Streich et al. |
| 6,619,397 | B2 | 9/2003 | Coon et al. |
| 6,644,404 | B2 | 11/2003 | Schultz et al. |
| 6,644,406 | B1 | 11/2003 | Jones |
| 6,666,274 | B2 | 12/2003 | Hughes |
| 6,695,067 | B2 | 2/2004 | Johnson et al. |
| 6,749,023 | B2 | 6/2004 | Nguyen et al. |
| 6,752,206 | B2 | 6/2004 | Watson et al. |
| 6,789,623 | B2 | 9/2004 | Hill, Jr. et al. |
| 6,814,144 | B2 | 11/2004 | Jones |
| 6,817,410 | B2 | 11/2004 | Wetzel et al. |
| 6,830,104 | B2 | 12/2004 | Nguyen et al. |
| 6,837,308 | B2 | 1/2005 | Michel |
| 6,883,608 | B2 | 4/2005 | Parlar et al. |
| 6,935,432 | B2 | 8/2005 | Nguyen |
| 6,983,796 | B2 | 1/2006 | Bayne et al. |
| 6,986,390 | B2 | 1/2006 | Doane et al. |
| 6,997,263 | B2 | 2/2006 | Campbell et al. |
| 7,044,231 | B2 | 5/2006 | Doane et al. |
| 7,051,805 | B2 | 5/2006 | Doane et al. |
| 7,055,598 | B2 | 6/2006 | Ross et al. |
| 7,096,945 | B2 | 8/2006 | Richards et al. |
| 7,100,691 | B2 | 9/2006 | Nguyen et al. |
| 7,104,324 | B2 | 9/2006 | Wetzel et al. |
| 7,108,060 | B2 | 9/2006 | Jones |
| 7,178,595 | B2 | 2/2007 | Michel |
| 7,243,732 | B2 | 7/2007 | Richard |
| 7,252,142 | B2 | 8/2007 | Brezinski et al. |
| 7,264,061 | B2 | 9/2007 | Dybevik et al. |
| 7,273,106 | B2 | 9/2007 | Huckabee et al. |
| 7,343,983 | B2 | 3/2008 | Livingstone |
| 7,367,395 | B2 | 5/2008 | Vidrine et al. |
| 7,392,852 | B2 | 7/2008 | Richard |
| 7,407,007 | B2 | 8/2008 | Tibbles |
| 7,431,085 | B2 | 10/2008 | Coronado et al. |
| 7,431,098 | B2 | 10/2008 | Ohmer et al. |
| 7,441,605 | B2 | 10/2008 | Coronado et al. |
| 7,562,709 | B2 | 7/2009 | Saebi et al. |
| 7,584,799 | B2 | 9/2009 | Coronado et al. |
| 7,591,321 | B2 | 9/2009 | Whitsitt et al. |
| 7,735,559 | B2 | 6/2010 | Malone |
| 2003/0000700 | A1 | 1/2003 | Hailey, Jr. |
| 2003/0034160 | A1 | 2/2003 | Nguyen et al. |
| 2004/0007829 | A1 | 1/2004 | Ross |
| 2004/0020652 | A1 | 2/2004 | Campbell et al. |
| 2004/0173350 | A1 | 9/2004 | Wetzel et al. |
| 2005/0039917 | A1 | 2/2005 | Hailey, Jr. |
| 2005/0263287 | A1 | 12/2005 | Achee, Jr. et al. |
| 2006/0124304 | A1 | 6/2006 | Bloess et al. |
| 2007/0056750 | A1 | 3/2007 | John et al. |
| 2008/0125335 | A1 | 5/2008 | Bhavsar |
| 2008/0128129 | A1 | 6/2008 | Yeh et al. |
| 2008/0142222 | A1 | 6/2008 | Howard et al. |
| 2008/0142227 | A1 | 6/2008 | Yeh et al. |
| 2008/0314589 | A1 | 12/2008 | Guignard et al. |
| 2009/0084556 | A1 | 4/2009 | Richards et al. |
| 2009/0159279 | A1 | 6/2009 | Assal |
| 2009/0159298 | A1 | 6/2009 | Assal |
| 2009/0283279 | A1 | 11/2009 | Patel et al. |
| 2009/0294128 | A1 | 12/2009 | Dale et al. |
| 2010/0000740 | A1 | 1/2010 | Dale et al. |
| 2010/0032158 | A1 | 2/2010 | Dale et al. |
| 2010/0038086 | A1 | 2/2010 | Bunnell et al. |
| 2010/0155064 | A1 | 6/2010 | Nutley et al. |

OTHER PUBLICATIONS

Edmont, B. et al., "Improvements in Horizontal Gravel Packing", Oilfield Review, Spring 2006, pp. 50-60.

Haeberle, D. C. et al., "Application of Flow-Control Devices for Water Injection in the Erha Field", IADC/SPE 112726, Mar. 4-6, 2008, 2008 IADC/SPE Drilling Conference, pp. 1-9, Orlando, FL.

Helmy, M. W. et al., "Application of New Technology in the Completion of ERD Wells, Sakhalin-1 Development", SPE 103587, Oct. 3-6, 2006, 2006 SPE Russian Oil & Gas Technical Conference, pp. 1-12, Moscow Russia.

European Search Report, Oct. 7, 2009, 2 pages.

SYSTEMS AND METHODS FOR PROVIDING ZONAL ISOLATION IN WELLS

CROSS REFERENCE TO RELATED APPLICATIONS

This application is the National Stage of International Application No. PCT/US10/27199, filed Mar. 12, 2010, which claims the benefit of U.S. Provisional Application No. 61/169,160, filed Apr. 14, 2009.

FIELD

The present disclosure relates generally to zonal isolation systems used in wells. More particularly, the present disclosure relates to systems and methods for providing gravel-based zonal isolation in a well.

BACKGROUND

This section is intended to introduce the reader to various aspects of art, which may be associated with embodiments of the present invention. This discussion is believed to be helpful in providing the reader with information to facilitate a better understanding of particular techniques of the present invention. Accordingly, it should be understood that these statements are to be read in this light, and not necessarily as admissions of prior art.

Producing oil and gas from subterranean formations has become increasingly challenging over the years, requiring continuing innovation in nearly every aspect of oil and gas operations. The continuing innovation enables current and future wells to reach reserves in reservoirs that were previously uneconomical. For example, multi-zone wells increase the efficiency of a single well, ultra-deep water wells access previously unreachable reservoirs, wells of greater depth and/or of extended reach wells may enable access to new and/or different reserves from new and/or existing wells, drilling and completion advances allows production from high pressure/temperature reservoirs, reservoirs having long intervals, reservoirs having high production rates, and reservoirs in remote locations. However, the technologies utilized to overcome the challenges increase the individual well cost dramatically and demands fewer wells for an economical field development. Consequently, the well productivity, reliability, and longevity become vital to avoid undesired production loss and expensive intervention or workovers.

As described above, many wells include multiple zones in one more intervals that may be of extended lengths. During operation of wells having multiple zones, it is important to control and manage fluids flowing to and from different zones. For example, in production operations, proper control of the fluid production rates in various zones can result in delaying water/gas coning and in maximizing reserve recovery. Various techniques are known to determine whether zonal isolation will be effective or desirable and where in a well to position the zonal isolation. Exemplary implementations of zonal isolations and inflow control devices installed in wells have been documented in various publications, including M. W. HELMY et al., "Application of New Technology in the Completion of ERD Wells, Sakhalin-1 Development," SPE 103587, October 2006; and David C. HAEBERLE et al., "Application of Flow-Control Devices for Water Injection in the Erha Field", SPE 112726, March 2008.

Exemplary operating conditions known to benefit from the use of zonal isolation technologies include the untimely production of water, gas, or other undesirable formation fluids.

Water can be produced together with hydrocarbonds during well production for a number of reasons, including the presence of native water zones, coning (rise of near-well hydrocarbon-water contact), high permeability streaks, natural fractures, and fingering from injection wells. Depending on the mechanism or cause of the water production, the water may be produced at different locations and times during a well's lifetime. Careful installation of zonal isolation in the initial completion allows an operator to shut-off the production from one or more zones during the well lifetime to limit the production of water or other desirable fluids.

Zonal isolation in open-hole completions is becoming increasingly more important for establishing and maintaining optimized long-term performance of both injection and production wells. In cases where gravel pack is needed for sand (particle) control, multi-zone gravel packing with zonal isolation in openhole completions had been challenging until the internal shunt alternate path technology was introduced. The internal shunt alternate path technology is described at least in U.S. Publication No. 2008/0142227, which is incorporated herein by reference in its entirety for all purposes, and M. D. BARRY et al., "Openhole Gravel Packing with Zonal Isolation," SPE 110460, November 2007. Zonal isolation in a open-hole, gravel-packed completion could be provided by a conventional packer element and secondary flow paths to enable both zonal isolation and alternate path gravel packing, such as described in U.S. Publication Nos. 2009/0294128 and 2010/0032158, which are each incorporated herein by reference in their entirety for all purposes. For example, enlarged and/or irregular boreholes, high pressure differentials, increasing number of zones per well, high temperatures, and temperature fluctuations each can challenge, and sometimes compromise, the effectiveness of the alternate path systems. In addition to these challenging environmental conditions, the operating conditions further complicate the efforts to provide a reliable, robust solution. For example, the longevity of the zonal isolation equipment is increasingly important as wells are required to produce for longer periods of time between workovers and treatment operations. Moreover, the risk or likelihood of water and/or gas production increases over the life of the well (due to increasing drawdown and depletion) requiring zonal isolation equipment that can endure the conditions of the well for extended periods.

For one or more of these reasons, there is a continuing need for improved zonal isolation technologies. Improved zonal isolation technologies would preferably provide one or more improvement such as being less sensitive to downhole conditions, being more forgiving of operational variables, being more flexible in its use and capabilities, being operationally easy to run into the well, position, and set, and/or being mechanically simple to improve tolerance to well conditions over time.

Prior efforts to improve upon mechanical packers for zonal isolation have provided improvements such as swellable packers. Still additional developments include the use of an annular gravel pack between a blank basepipe segment and a wellbore wall having very low permeability, such as a shale section of the well. The annular gravel pack forms an axial zonal isolation and provides substantial flow resistance. However, it is not possible for such gravel pack barrier to form without introducing a proper fluid leakoff path to dehydrate the gravel slurry. Due to the low permeability of the formation, the fluid leak-off in such implementations is through the basepipe to return to surface. One example of such a system is seen in U.S. Pat. No. 6,520,254 to Hurst et al. However, if any leak-off path exists, water or gas production will follow the same path and render the isolation functionality of the gravel pack ineffective. Accordingly, there is a continuing need for zonal isolation systems and methods.

Other related material may be found in at least U.S. Pat. Nos. 7,527,095; 6,318,465; 6,619,397; and 7,108,060.

SUMMARY

In some implementations of the present invention, a tubular assembly adapted for downhole use in wells includes an upstream manifold, a gravel packing conduit, a transport conduit, and a leak-off conduit. The upstream manifold is adapted to receive a gravel-laden slurry. The gravel packing conduit is in fluid communication with the upstream manifold and extends longitudinally away from the upstream manifold. The gravel packing conduit is adapted to receive at least a portion of the gravel-laden slurry from the upstream manifold and is adapted to be in fluid communication with an annulus between a wellbore wall and the tubular assembly when the tubular assembly is disposed downhole in a well. The gravel packing conduit is adapted to communicate gravel-laden slurry into the annulus during isolation forming operations. Moreover, the gravel packing conduit is at least substantially isolated from direct fluid communication with a downstream flow path. The transport conduit is in fluid communication with the upstream manifold and in fluid communication with the downstream flow path. The leak-off conduit is in at least partially restricted fluid communication with the upstream manifold and is in fluid communication with the downstream flow path in a region longitudinally spaced from the upstream manifold. The leak-off conduit is in fluid communication with the annulus through permeable media adapted to retain particles while communicating fluids, thereby providing fluid leak-off from the annulus during the isolation forming operations.

Numerous variations on the tubular assembly are possible, at least some of which are described in this Summary and others are described herein. The gravel packing conduit may include at least one flow path adapted to gravel pack an interval of the wellbore. Additionally or alternatively, the at least partially restricted fluid communication between the upstream manifold and the leak-off conduit and the fluid communication between the leak-off conduit and the downstream flow path may be configured to maintain the fluid pressure in the leak-off conduit below a pressure in the annulus and a pressure in the gravel packing conduit during at least a portion of the isolation forming operations. In such implementations, the fluid pressure in the leak-off conduit may increase as isolation forming operations progress, as downstream portions of a well are gravel packed, for example. As the further downstream portions are gravel packed, the back pressure from downhole may cause gravel-laden slurry to enter the leak-off conduit from at least one of the downstream flow path and the transport conduit as isolation forming operations progress. As gravel-laden slurry enters the leak-off conduit, the fluid in the gravel-laden slurry in the leak-off conduit may exit the leak-off conduit into at least one of the annulus and a basepipe associated with the tubular assembly thereby gravel packing the leak-off conduit. The fluid may exit the leak-off conduit through at least one flow control valve, such as a nozzle, a one-way valve, etc. When the leak-off conduit is gravel packed, the gravel packed leak-off conduit and the gravel-packed annulus together provide a zonal isolation assembly in the wellbore.

In some implementations, the leak-off conduit and the gravel packing conduit may be adapted to provide a zonal isolation assembly in the wellbore in a region adjacent the tubular assembly. The zonal isolation assembly is adapted to at least substantially isolate annular intervals on either side of the tubular assembly. In some implementations, the zonal isolation assembly may be formed during gravel packing operations. Additionally or alternatively, the zonal isolation assembly may be formed in association with an imperfect isolation device to provide enhanced zonal isolation.

Additionally or alternatively, some implementations of the tubular assemblies described herein may be configured such that at least one of the gravel packing conduit, the transport conduit, and the leak-off conduit is operatively associated with a base pipe. In some implementations, at least one of the upstream manifold, the transport conduit, the leak-off conduit, and the gravel packing conduit may be adapted to promote fluid flow from the upstream manifold into the gravel packing conduit. Still further, some tubular assemblies may be configured to provide the fluid communication between the leak-off conduit and the downstream flow path through a double-U assembly.

The present disclosure further describes methods for providing a gravel-based zonal isolation system in a hydrocarbon-related well. In some implementations, the methods include providing a tubular assembly, which may be according to the description above. The methods may further include positioning the tubular assembly at a predetermined position within a well. The methods further include pumping gravel-laden slurry to the upstream manifold and flowing at least a portion of the gravel-laden slurry to the gravel packing conduit of the tubular assembly to gravel pack an annulus between the tubular assembly and a wellbore wall. The gravel pack in the annulus is then dehydrated through at least the permeable media of the leak-off conduit. The filtrate through the permeable media flows through the leak-off conduit to the downstream flow path. The methods further include gravel packing the leak-off conduit with gravel-laden slurry from at least one of the upstream manifold, the downstream flow path, and the transport conduit. The leak-off conduit gravel pack is dehydrated to at least one of the annulus and a basepipe associated with the tubular assembly. The leak-off conduit gravel pack and the annular gravel pack are adapted to provide a zonal isolation system.

The methods and equipment used therein may be varied in any suitable manner. For example, the tubular assembly may be varied according to any of the descriptions provided above or elsewhere herein. Additional examples of variations on the methods are described in this Summary and elsewhere herein. In some implementations of the present methods, the tubular assembly may be coupled to downhole equipment when positioned at a predetermined position within the well, such as one or more of annular coiled tubing, production tubing basepipe, sand control equipment, and gravel pack equipment. In some implementations, the methods include flowing at least a majority of the gravel-laden slurry in the upstream manifold to the gravel-packing conduit. Additionally or alternatively, some implementations may include dehydrating the gravel pack in the annulus through the wellbore wall to a formation.

Some implementations of the present methods may include gravel packing distal regions of the well with gravel-laden slurry of which at least a portion flowed through the transport conduit. The gravel packing of the distal regions may utilize at least one of conventional gravel packing technology and alternate path gravel packing technology. In some implementations, the gravel packing of distal regions may include providing at least one additional gravel-based zonal isolation assembly.

Exemplary variations on the equipment that may be used with the present methods include a tubular assembly having at least two gravel packing conduits in fluid communication with the upstream manifold and the annulus. Additionally or alternatively, the gravel packing conduit(s) may be in direct fluid communication with only the upstream manifold and the annulus. The permeable media of the leak-off conduit may comprise a plurality of openings, such as may be provided by a slotted tube and/or a sand screen.

The present disclosure further discloses methods of operating a hydrocarbon-related well. Exemplary methods may include conducting gravel packing operations in a wellbore utilizing at least one sand screen; forming a gravel-based zonal isolation system in the wellbore while conducting gravel packing operations; and conducting at least one additional operation in the wellbore utilizing the gravel-based zonal isolation device.

In such methods, forming a gravel-based zonal isolation system may utilize a tubular assembly comprising: an upstream manifold; a gravel packing conduit in fluid communication with the upstream manifold and extending longitudinally away from the upstream manifold; wherein the gravel packing conduit is adapted to receive a gravel-laden slurry from the upstream manifold; wherein the gravel packing conduit is adapted to be in fluid communication with an annulus between a wellbore wall and the tubular assembly when the tubular assembly is disposed downhole in a well; wherein the gravel packing conduit is adapted to communicate the gravel-laden slurry into the annulus during isolation forming operations; and wherein the gravel packing conduit is at least substantially isolated from direct fluid communication with a downstream flow path; a transport conduit in fluid communication with the upstream manifold and in fluid communication with the downstream flow path; and a leak-off conduit; wherein the leak-off conduit is in at least partially restricted fluid communication with the upstream manifold; wherein the leak-off conduit is in fluid communication with the downstream flow path in a region longitudinally spaced from the upstream manifold; and wherein the leak-off conduit is in fluid communication with the annulus through permeable media adapted to retain particles while communicating fluids providing fluid leak-off from the annulus during the isolation forming operations. In some implementations, the gravel packing conduit comprises at least two gravel packing conduits in fluid communication with the upstream manifold and the annulus. Still further, in some implementations, the gravel packing conduit is in direct fluid communication with only the upstream manifold and the annulus.

The methods described herein include forming a gravel-based zonal isolation system, which may include a steps such as: positioning the tubular assembly at a predetermined position within a well; pumping gravel-laden slurry to the upstream manifold; flowing at least a portion of the gravel-laden slurry to the gravel packing conduit to gravel pack an annulus between the tubular assembly and a wellbore wall; dehydrating the gravel pack in the annulus through at least the permeable media of the leak-off conduit; wherein filtrate through the permeable media flows through the leak-off conduit to the downstream flow path; and gravel packing the leak-off conduit with gravel laden slurry from at least one of the downstream flow path and the transport conduit; wherein the leak-off conduit gravel pack is dehydrated to at least one of the annulus and a basepipe associated with the tubular assembly; and wherein the leak-off conduit gravel pack and the annular gravel pack are adapted to provide a zonal isolation zonal.

The methods of forming a gravel-based zonal isolation system may similarly include a number of variations. For example, flowing at least a portion of the gravel-laden slurry to the gravel packing conduit may comprise flow at least a majority of the gravel-laden slurry in the upstream manifold to the gravel-packing conduit. Additionally or alternatively, dehydrating the gravel pack in the annulus may include dehydrating fluids through the wellbore wall to a formation. The methods may include further steps such as gravel packing distal regions of the well with gravel-laden slurry, at least a portion of which flowed through the transport conduit. In such methods, gravel packing distal regions of the well may utilize conventional gravel packing technology. Additionally or alternatively, gravel packing distal regions may include providing at least one additional gravel-based zonal isolation assembly.

BRIEF DESCRIPTION OF THE DRAWINGS

The foregoing and other advantages of the present technique may become apparent upon reading the following detailed description and upon reference to the drawings in which.

Figure 1:
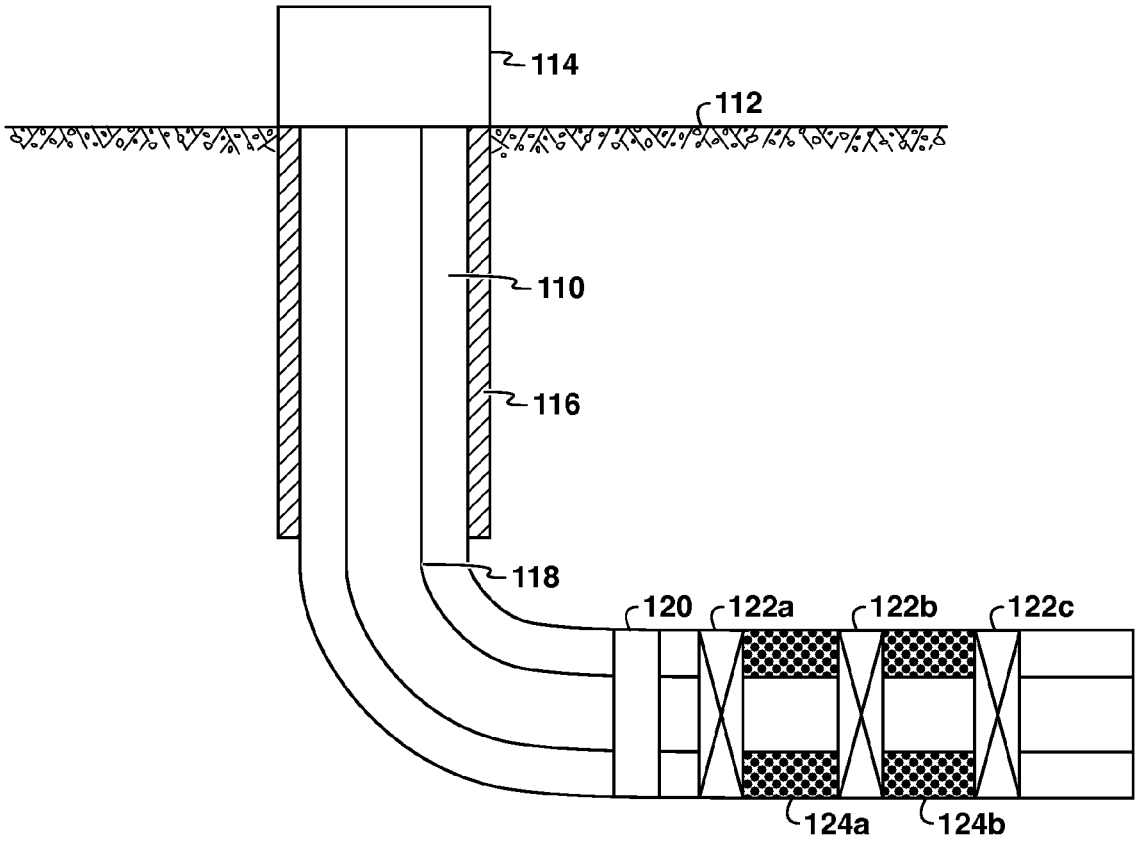
FIG. 1 (Prior Art)
FIG. 1 is a schematic view of a conventional well including zonal isolation systems and gravel-packed zones.

While the technologies of the present disclosure are susceptible to various modifications and alternative forms, specific exemplary embodiments thereof are shown in the drawings and are herein described in detail. It should be understood, however, that the description herein of specific exemplary embodiments is not intended to limit the disclosure to the particular forms disclosed herein, but on the contrary, this disclosure is to cover all modifications and equivalents of the technologies defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles. For the purposes of clarity, not every component is labeled in every figure, nor is every component of each embodiment of the invention shown where illustration is not necessary to allow those of ordinary skill in the art to understand the invention.

DETAILED DESCRIPTION

Terms and Terminology

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The indefinite articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

About: As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Above/below: In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Continuing with the example of relative directions in a wellbore, "upper" and "lower" may also refer to relative positions along the longitudinal dimension of a wellbore rather than relative to the surface, such as in describing both vertical and horizontal wells.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Based on: "Based on" does not mean "based only on", unless expressly specified otherwise. In other words, the phrase "based on" describes both "based only on," "based at least on," and "based at least in part on," which may be used interchangeably herein.

Comprising: In the claims, as well as in the specification, all transitional phrases such as "comprising," "including,"

"carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Couple: Any use of any form of the terms "connect", "engage", "couple", "attach", or any other term describing an interaction between elements is not meant to limit the interaction to direct interaction between the elements and may also include indirect interaction between the elements described.

Embodiments: Reference throughout the specification to "one embodiment," "an embodiment," "some embodiments," "one aspect," "an aspect," "some aspects," "some implementations," "one implementation," or "an implementation" means that a particular component, feature, structure, method, or characteristic described in connection with the embodiment, aspect, or implementation is included in at least one embodiment and/or implementation of the claimed subject matter. Thus, the appearance of the phrases "in one embodiment" or "in an embodiment" or "in some embodiments" (or "aspects" or "implementations") in various places throughout the specification are not necessarily all referring to the same embodiment and/or implementation. Furthermore, the particular features, structures, methods, or characteristics of any one or more embodiments or implementations may be combined in any suitable manner in one or more additional or different embodiments or implementations.

Exemplary: "Exemplary" is used exclusively herein to mean "serving as an example, instance, or illustration." Any embodiment described herein as "exemplary" is not necessarily to be construed as preferred or advantageous over other embodiments.

Flow diagram: Exemplary methods may be better appreciated with reference to flow diagrams or flow charts. While for purposes of simplicity of explanation, the illustrated methods are shown and described as a series of blocks, it is to be appreciated that the methods are not limited by the order of the blocks, as in different embodiments some blocks may occur in different orders and/or concurrently with other blocks from that shown and described. Moreover, less than all the illustrated blocks may be required to implement an exemplary method. In some examples, blocks may be combined, may be separated into multiple components, may employ additional blocks, and so on. In some examples, one or more of the blocks may be performed by a combination of equipment and operators. Additionally or alternatively, one or more blocks may be performed by equipment alone and/or by computer systems. In some examples utilizing computerized systems, blocks may be implemented in logic or processing blocks may represent functions and/or actions performed by functionally equivalent circuits (e.g., an analog circuit, a digital signal processor circuit, an application specific integrated circuit (ASIC)), or other logic device. Blocks may represent executable instructions that cause a computer, processor, and/or logic device to respond, to perform an action(s), to change states, and/or to make decisions. While the figures illustrate various actions occurring in serial, it is to be appreciated that in some examples various actions could occur concurrently, substantially in parallel, and/or at substantially different points in time.

Operatively connected and/or coupled: Operatively connected and/or coupled means directly or indirectly connected for transmitting or conducting information, force, energy, or matter.

Operatively associated: Operatively associated means the recited components or elements are disposed relative to each other in a manner to accomplish the recited operation. Depending on the components described as being operatively associated, the association may be by way of coupling or other connection, by way of disposition near or adjacent to each other, or by way of other relationships. For example, an optical sensor may be operatively associated with another component by being in a line of sight with the other component. Other relationships may be require greater proximity, fluid tight connection, thermal relationships, electrical relationships, etc. Operatively associated refers to all suitable relationships identifiable to one of skill in the art for accomplishing the recited operative functionality.

Order of steps: It should also be understood that, unless clearly indicated to the contrary, in any methods claimed herein that include more than one step or act, the order of the steps or acts of the method is not necessarily limited to the order in which the steps or acts of the method are recited.

Preferred: "preferred" and "preferably" refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

Description

Reference will now be made to exemplary embodiments and implementations. Alterations and further modifications of the inventive features described herein and additional applications of the principles of the invention as described herein, such as would occur to one skilled in the relevant art having possession of this disclosure, are to be considered within the scope of the invention. Further, before particular embodiments of the present invention are disclosed and described, it is to be understood that this invention is not limited to the particular process and materials disclosed herein as such may vary to some degree. Moreover, in the event that a particular aspect or feature is described in connection with a particular embodiment, such aspects and features may be found and/or implemented with other embodiments of the present invention where appropriate. Specific language may be used herein to describe the exemplary embodiments and implementations. It will nevertheless be understood that such descriptions, which may be specific to one or more embodiments or implementations, are intended to be illustrative only and for the purpose of describing one or more exemplary embodiments. Accordingly, no limitation of the scope of the invention is thereby intended, as the scope of the present invention will be defined only by the appended claims and equivalents thereof.

In the interest of clarity, not all features of an actual implementation or operation are described in this disclosure. For example, some well-known features, principles, or concepts, are not described in detail to avoid obscuring the invention. It will be appreciated that in the development of any actual embodiment or in the operation of any actual implementation, numerous implementation-specific decisions may be made to achieve specific goals, such as compliance with system-related, process-related, and business-related constraints, which will vary from one implementation to another. For example, the specific details of an appropriate gravel-packing fluid, basepipe materials, connections, etc. for implementing methods of the present invention may vary from one implementation to another. Moreover, it will be appreciated that decision-making efforts required to finalize these details for an actual implementation may be complex and time-consuming, but would nevertheless be a routine undertaking for those of ordinary skill in the art having the benefit of the present disclosure.

FIG. 1 illustrates a schematic view of a conventional multi-zone gravel packing operation. For purposes of discussion, the primary, somewhat generic components of a hydrocarbon-related well are identified here and may be referred to throughout the remaining discussion. For example, FIG. 1 illustrates that the well 110 is drilled through the surface 112 and extends away from the surface. As illustrated, the well 110 is a directional well including vertical and horizontal segments. The technologies of the present invention are not limited in implementation to directional wells and may be implemented in any well. FIG. 1 further illustrates schematically that the well 110 is associated with surface equipment 114, which is illustrated as a simple block representative of the multitude of equipment configurations that may be associated with a well, such as for drilling, treatments, workovers, production, etc.

Still additionally, FIG. 1 illustrates that well 110 includes cased-hole segments enclosed or supported by casing 116 and other open-hole segments without casing. While this overview illustration of a well illustrates the gravel-packed zones in an open-hole segment, which is most conventional, the technologies of the present invention are not limited to implementations in an open-hole segment. FIG. 1 further illustrates a tubing string 118 extending from the surface equipment 114 into the well 110. It should be noted that the dimensions and the relative dimensions of the various components in FIG. 1 are not to scale but are sized for the purpose of illustrating key principles. Moreover, it should be noted that the Figures are schematic and do not show all of the details of the various components. For example, the tubing string 118 is comprised of multiple tubing joints and other components not illustrated.

As indicated, FIG. 1 illustrates a conventional multi-zone gravel packed well. The production string 118 includes multiple components used in created and providing the multi-zone gravel packed well, several of which are illustrated in FIG. 1. For example, the production string 118 includes a cross-over 120, such as may be used to exchange fluids between the interior of the production string and the annulus (e.g., during gravel packing operations). Additionally, FIG. 1 illustrates a plurality of packers 122 providing the zonal isolation of the well 110. As described above, the packers 122 may include internal shunts adapted to coordinate with other alternate path gravel packing equipment that may be used in gravel packing the well. Exemplary descriptions of internal shunt packers to enable multi-zone gravel packing in open-hole wells can be found at least in U.S. Patent Publication Nos. 2009/0294182 and 2010/0032158, each of which was previously incorporated. FIG. 1, being schematic, does not show all of the gravel packing equipment that may be used in creating or using the gravel pack, such as sand screens, shunt tubes, etc. Exemplary descriptions of alternate path gravel packing technologies are abundant. A non-exhaustive listing of such technologies includes U.S. Pat. Nos. 4,945,991; 5,082,052; 5,113,935; 5,161,613; 5,161,618; 5,333,688; 5,333,689; 5,417,284; 5,419,394; 5,435,391; 5,515,915; 5,588,487; 5,560,427; 5,690,175; 5,848,645; 5,842,516; 5,868,200; 5,890,533; 6,464,007; 6,644,406; 7,108,060; and 6,588,506; 6,059,032; 6,227,303; 6,220,345; 6,814,144; U.S. Patent Publication Nos. 2008/0128129; 2008/0142227; 2009/0294128; and 2010/0032158; each of which is incorporated herein by reference for the purpose of describing various gravel packing equipment and methods that may be used together with the present systems and methods and/or that may be improved or augmented by the present systems and methods. As illustrated in FIG. 1, the packers 122 and other gravel packing equipment work together to provide the isolated gravel packed zones 124. Specifically, packer 122*b* is positioned to provide zonal isolation between gravel pack zone 124*a* and gravel pack zone 124*b*. Such zonal isolation may be desired for a variety of reasons understood by those in the art, including fluid flow control during production and/or treatment operations.

Figure 2:
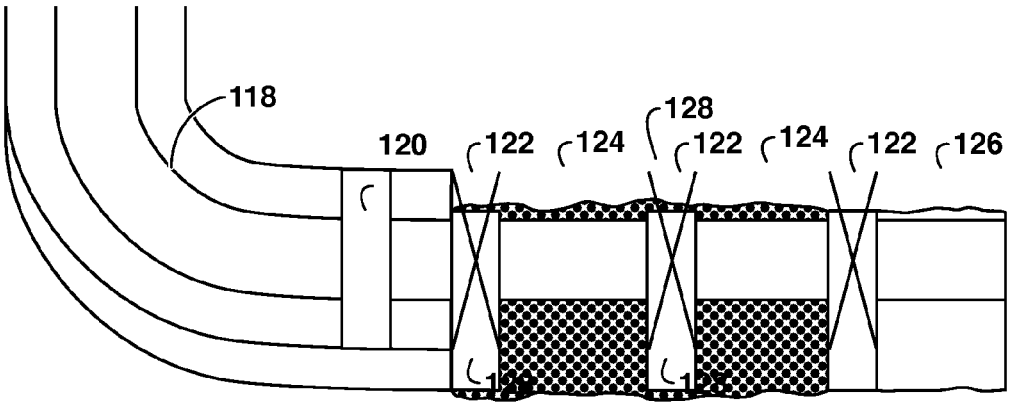
FIG. 2 (Prior Art)
FIG. 2 is an enlarged schematic view of a conventional open-hole well including zonal isolation systems and gravel-packed zones.

FIG. 2 provides an enlarged view of the schematic gravel-packed zones 124 and packers 122. FIG. 2 illustrates at least one of the problems encountered when utilizing a mechanical packer in an open-hole completion. The wellbore walls 126 of an open-hole completion are rarely perfectly circular and are even more rarely smooth and continuous over any measurable length as seen in FIG. 2. Accordingly, even the most perfectly sized mechanical packer will rarely provide perfect isolation between zones. Certain expandable mechanical packers provide better results but are generally unable to accommodate the changing shape of the wellbore wall as it evolves during the course of production and treatment operations. As illustrated in FIG. 2, this inability to conform to the shape of the wellbore wall 126 results in gaps 128 between the packer 122 and the wellbore wall 126, some of which are illustrated as being at least partially filled with gravel and others illustrated as being void space. The gaps 128 between the packer 122 and the wellbore wall 126, whether a void space or partially filled with gravel, provides a flow path for fluids between adjacent zones, defeating the attempted zonal isolation.

Figure 3:
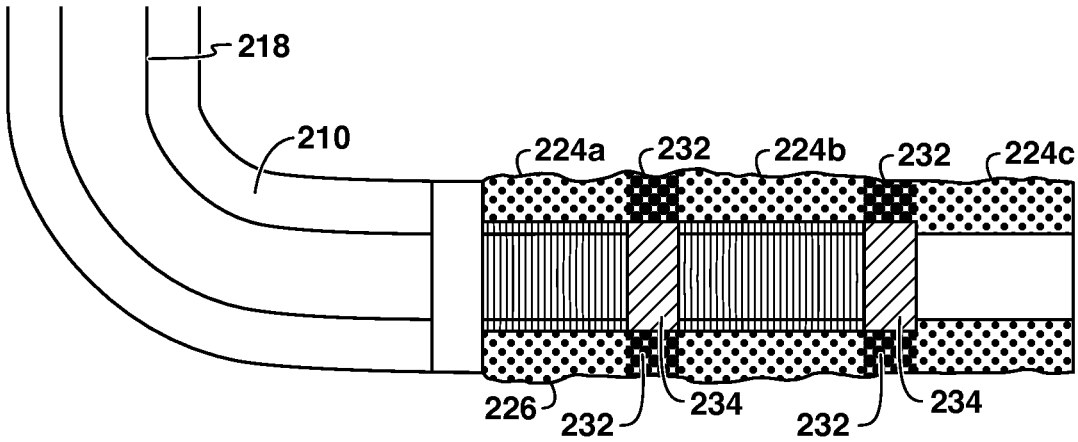
FIG. 3 is a schematic view of a well provided with a gravel-based zonal isolation system of the present disclosure.

FIG. 3 provides an overview illustration of a gravel-based zonal isolation system according to the present technologies. Similar to the multi-zone gravel-packed well of FIGS. 1 and 2, the well 210 of FIG. 3 includes a tubing string 218 and a crossover 220, such as may be used in gravel packing operations. Additionally, the well 210 of FIG. 3 includes a plurality of gravel-packed zones 224. However, in contrast to FIGS. 1 and 2, the gravel-packed well 210 of FIG. 3 includes isolated gravel-packed zones without the use of mechanical packers or other mechanical isolation systems. FIG. 3 illustrates gravel-based zonal isolation systems 232 providing the zonal isolation between the three gravel-packed zones 224*a-c*. As will be described more fully below, the gravel-based zonal isolation systems 232 may be provided in the well using any of the tubular assemblies 234 described below and using any of the methods described herein.

It should be noted the relative positions, sizes, etc. of the gravel-packed zones 224 and the gravel-based zonal isolation systems 232 in FIG. 3 are representative only. The number of zones, the length of the zones, the position of the gravel-based zonal isolation systems 232, the length of the gravel-based zonal isolation systems, etc. may all be varied to accommodate the conditions of the particular well and formation in which the present technologies are implemented. In some implementations, for example, the gravel-based zonal isolation systems 232 may be disposed adjacent a low permeability formation and sufficient zonal isolation may be provided by a gravel-based zonal isolation system of relatively short length, such as between about 1 feet and about 40 feet.

In other implementations, the zonal isolation may be desired at a position where the formation is more permeable. As described above, when the wellbore wall 226 adjacent a zonal isolator is poorly consolidated, permeable, or otherwise susceptible to fluid flow therethrough to flow around the zonal isolator. However, the gravel-based zonal isolation system 232 of the present technologies overcomes these challenges with conventional zonal isolators in a plurality of manners. For example, the gravel-pack of the gravel-based zonal isolation system 232 supports the wellbore wall 226, even those that are more poorly consolidated. Additionally, because the gravel-based zonal isolation systems can be formed of any desired length, the length of a given gravel-based zonal isolation system 232 may be selected such that the distance fluid would travel through the gravel and/or permeable formation is sufficiently long to effectively isolate the adjacent zones. Depending on the characteristics of the formation and the gravel-pack obtained through the present technologies, gravel-based zonal isolation systems 232 may extend from about 1 feet in length to about 40 feet in length (e.g., the length of a conventional tubing joint) to over about 100 feet. As can be understood, the length of the gravel-based zonal isolation system is limited only the practicalities of the materials costs and the characteristics of the well and formation. In some implementations where a long gravel-based zonal isolation system is desired, it may be preferred to utilize multiple tubular assemblies in series rather than a single, long tubular assembly.

Figure 4:
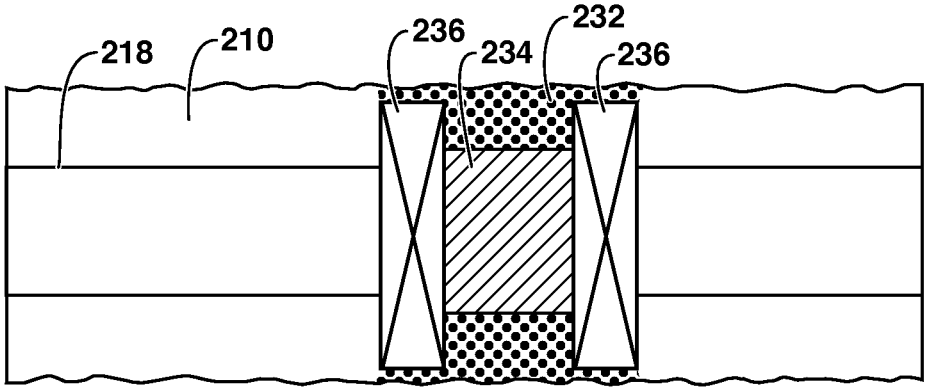
FIG. 4 is a schematic view of a gravel-based zonal isolation system of the present disclosure.

As illustrated in FIG. 3, the gravel-packed zonal isolation systems 232 are provided between gravel-packed zones 224. As will be better understood from the remainder of this description, the adjacent gravel-packed zones 224 cooperate with the tubular assemblies 234 to pack the gravel into the gravel-based zonal isolation systems 232. FIG. 4 illustrates that gravel-based zonal isolation systems 232 may be provided in a well without an adjacent gravel pack. In the schematic illustration of FIG. 4, it can be seen that a gravel-based zonal isolation system may be formed adjacent to a mechanical packer 236 or, as illustrated, between mechanical packers. While mechanical packers 236 continue to suffer from the challenges described above, the mechanical packers 236 together with the gravel-based zonal isolation system 234 of the present disclosure provides more effective zonal isolation. In implementations such as those illustrated in FIG. 4, the mechanical packer 236 may be as simple as a cup-type packer, a swell packer, or may be any other form of packer. It is worth noting that the mechanical packers 236 of FIG. 4 are not intended to create long-term zonal isolation or even complete zonal isolation on their own. Accordingly, the mechanical packers 236 can be of simpler configuration, cheaper construction, and easier operation. The mechanical packers 236 may be provided by any enlarged portion or appendage to the tubing string 218 that, together with the wellbore wall 226, sufficiently restricts the flow of gravel in the annulus past the packer 236 resulting in gravel accumulation in the region, which accumulation becomes a gravel-based zonal isolation system. While FIGS. 3 and 4 illustrate gravel-based zonal isolation assemblies 234 formed with gravel packs 224 on both sides or with mechanical packers 236 on both sides, it will be understood that the gravel-based zonal isolation systems 234 may be formed with any combination or variation of mechanical packers and gravel packs. In some implementations, the gravel-based zonal isolation systems 234 may be effectively formed with a packer and/or a gravel pack on the upstream side, on the downstream side, or both sides of the gravel-based zonal isolation system.

Figure 5:
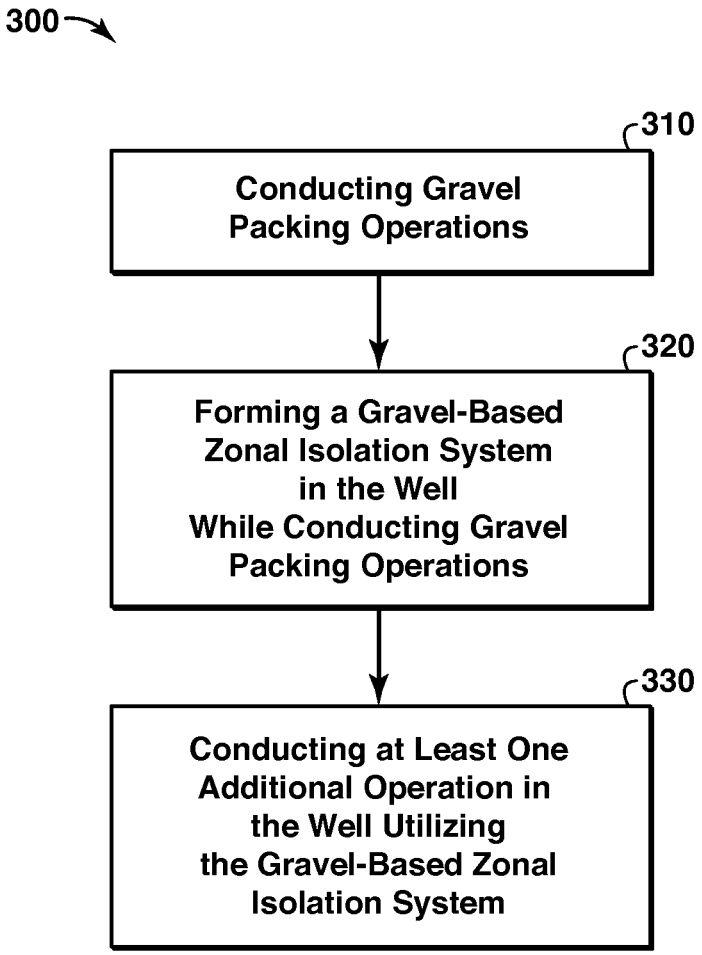
FIG. 5 is a flow chart of exemplary methods within the scope of the present disclosure.
Figure 6:
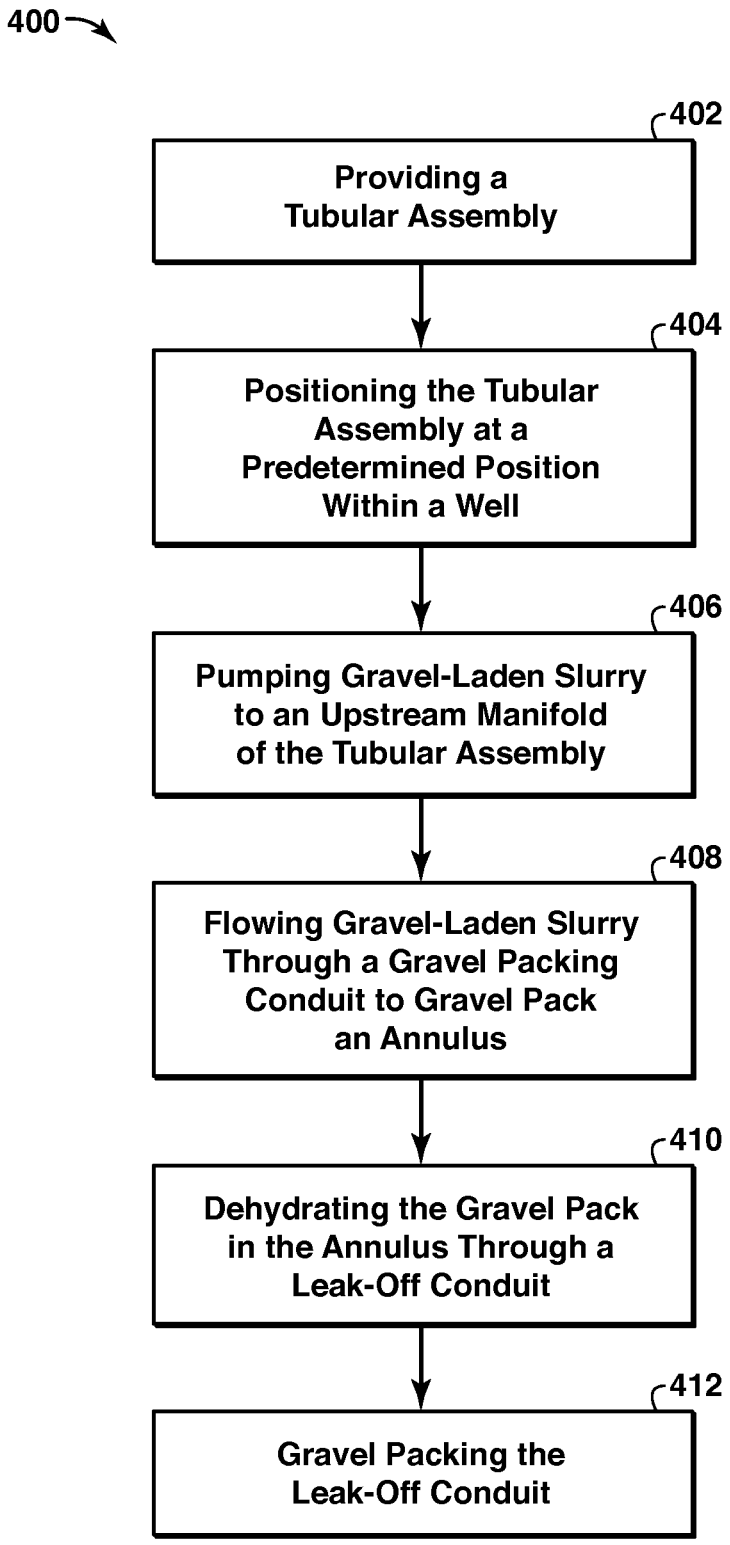
FIG. 6 is a flow chart of exemplary methods for providing gravel-based zonal isolation systems.

The formation of the gravel-based zonal isolation systems 234 of FIGS. 3 and 4 will be better understood in connection with FIGS. 5 and 6 illustrating exemplary methods of forming gravel-based zonal isolation systems. As illustrated in FIG. 5, methods of operating a hydrocarbon-related well are illustrated generally by flow chart 300. In some implementations, the methods 300 begin by conducting gravel packing operations at box 310. The gravel packing operations may be conducted according to any suitable gravel packing methods and utilizing any suitable gravel packing equipment, including sand screens, alternate path equipment and methods, and still to be developed technologies. The gravel used in the gravel packing operations may be any suitable gravel, sand, or other materials commonly used in gravel packing operations. Exemplary gravel may include resin-coated sand or proppant.

The methods 300 further include forming a gravel-based zonal isolation system in the well while conducting gravel packing operations, as at box 320. It should be noted that the gravel-based zonal isolation system is formed in situ in the well rather than being run into the well already formed. Forming the gravel-based zonal isolation system in situ allows the gravel packing and the formation of zonal isolation to occur during a single operating step. which may result in eliminating one or more of: 1) time, expense, operational complexity, and equipment associated with running equipment into and out of the well to activate the mechanical packers; 2) time, expense, operational complexity, and equipment associated with hydraulic pumping that may be used to inflate/activate mechanical packers; and 3) time, expense, operational complexity, and equipment associated with swelling a packer chemically.

FIG. 5 further illustrates that the methods 300 include conducting at least one additional operation in the well utilizing the gravel-based zonal isolation system, as at box 330. The additional operation may be any suitable operation for the given well. For example, the gravel packing operations may be continued to pack one or more additional gravel-pack zone 224, an additional gravel-based zonal isolation system 232 may be formed, treatment operations may be conducted, and/or production operations may be conducted. Regardless of the nature of the subsequent additional operation(s), the additional operation utilizes the gravel-based zonal isolation system. In treatment operations, for example, the gravel-based zonal isolation system 232 may be used to preferential treat one zone over another. In production operations, the gravel-based zonal isolation system may be used to control formation fluid flow through the well. Other manners of conducting operations in a well utilizing a gravel-based zonal isolation system will be readily apparent.

FIG. 6 provides a schematic flow chart 400 of methods for providing a gravel-based zonal isolation system in a hydrocarbon-related well. The methods 400 may be implemented in connection with the methods 300 of FIG. 5 and/or may be conducted independent of the methods of FIG. 5 (e.g., the methods 400 of FIG. 6 may or may not be implemented together with the gravel packing operations and/or may or may not be followed by conducting at least one additional operation in the well). FIG. 6 is another schematic flow chart intended to provide a general understanding of the methods within the scope of the present technologies. The methods will be better understood in connection with the description of the tubular assembly provided below and the schematic illustrations of various stages in an exemplary method within the scope of the present technology, which also are provided below.

The methods 400 of providing a gravel-based zonal isolation system are illustrated as beginning with providing a tubular assembly, at 402, which tubular assembly may be as described below. At 404, the methods continue by positioning the tubular assembly at a predetermined position with a well. As described above, the present technologies allow a gravel-based zonal isolation system to be formed in situ at virtually any location within a well. Accordingly, positioning the tubular assembly at a predetermined position refers to positioning the tubular assembly at whatever locations are suggested by the formation and reservoir characteristics and the operating plans for the well. In some implementations, multiple tubular assemblies may be provided and positioned within the well. The relative locations of the tubular assembly(ies) within the well are entirely dependent of the conditions of the well and the reservoir rather than the equipment or the operators. As will be understood from the description herein, the tubular assemblies may be positioned in series and/or may be spaced from each other to facilitate gravel packing of the well.

With the tubular assembly(ies) in position in the well, the methods 400 continue at 406 by pumping gravel-laden slurry to an upstream manifold of the tubular assembly. The upstream manifold may be configured to collect gravel-laden slurry from an annulus for redistribution among various flow conduits, as will be better understood with reference to FIGS. 7-13. Additionally or alternatively, the upstream manifold may be configured to collect gravel-laden slurry from one or more flow conduits other than the annulus for redistribution among one or more downstream flow conduits. As just one example, a tubular assembly positioned downstream of another tubular assembly and/or downstream of another alternate path tubular may receive gravel-laden slurry from various flow paths, which may or may not include the annulus.

The gravel-laden slurry in the upstream manifold, or at least a portion thereof, is flowed, at 408, through a gravel packing conduit of the tubular assembly to gravel pack the annulus between the tubular assembly and the wellbore wall. The gravel packing conduit of the tubular assembly may be configured in a variety of suitable manners to receive gravel-laden slurry from the upstream manifold and to distribute the gravel-laden slurry to the annulus. In some implementations, the gravel packing conduit may be similar to gravel-packing shunt tubes of prior alternate path gravel packing technologies.

FIG. 6 further illustrates that methods 400 for forming gravel-based zonal isolation systems includes, at 410, dehydrating the gravel pack in the annulus through a leak-off conduit of the tubular assembly. In some implementations, the gravel-based zonal isolation systems may be positioned in a well adjacent a less permeable formation with limited leak-off characteristics. Gravel-laden slurry flowing into an annulus with no formation to provide leak-off generally does not form a gravel-pack. In such implementations, the leak-off conduit of the tubular assembly provides a flow path for dehydrating the gravel pack in the annulus allowing the gravel pack to form and compact as additional gravel-laden slurry is flowed into the annulus. In other implementations, the formation may be more permeable providing some leak-off from the annulus. In such implementations, the leak-off conduit may accelerate the dehydration. Dehydrating the gravel pack in the annulus through the leak-off conduit provides the advantage of having a more consistent or uniform gravel pack in the annulus. In some implementations, the leak-off conduit in association with the gravel pack conduit may be adapted to provide a more complete gravel pack in the region adjacent the tubular assembly.

At 412, FIG. 6 illustrates that the methods include gravel packing the leak-off conduit. During the gravel packing operations, the leak-off conduit provides a route for fluids to dehydrate the annulus. While advantageous during the gravel-packing operations, this dehydration flow route becomes a production fluid flow path or a treatment fluid flow path in subsequent operations, which would defeat the intended isolation established by the gravel packed annulus. Accordingly, the leak-off conduit is gravel packed to close or at least effectively close the fluid flow path through the leak-off conduit. In some implementations, the gravel pack in the leak-off conduit will be sufficient alone to effectively close the fluid flow path. Additionally or alternatively, the leak-off conduit may be provided with adaptive flow control features that can be triggered through various means to further close the flow through the leak-off conduit. Such features will be described further in connection with the Figures of the schematic tubular assembly.

Continuing with the discussion of FIG. 6, it can be seen that the formation of a gravel pack in the annulus and the formation of a gravel pack in the leak-off conduit together provide a gravel-based zonal isolation device restricting flow axially through the well between adjacent zones. The gravel pack in the annulus may have a permeability similar to other gravel-packed zones of the well, but may provide effective zonal isolation due to the inability of fluids to enter the tubular assembly, the distance the fluids would be required to travel through the gravel pack of the gravel-based zonal isolation device, and/or the characteristics of the formation.

Figure 7A:
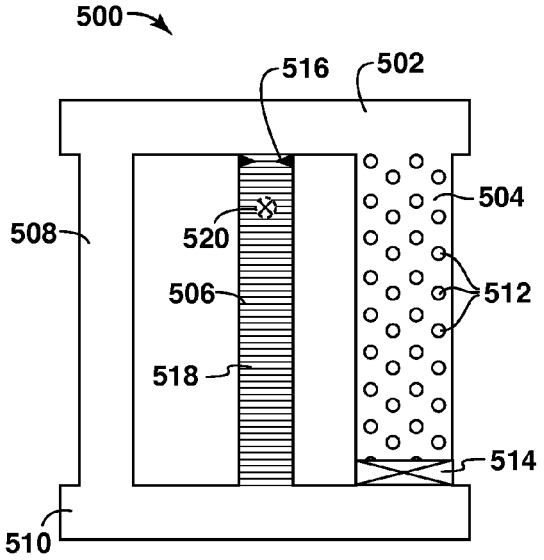
FIG. 7A is a schematic illustration of a tubular assembly adapted for use in providing a gravel-based zonal isolation system.
Figure 7B:
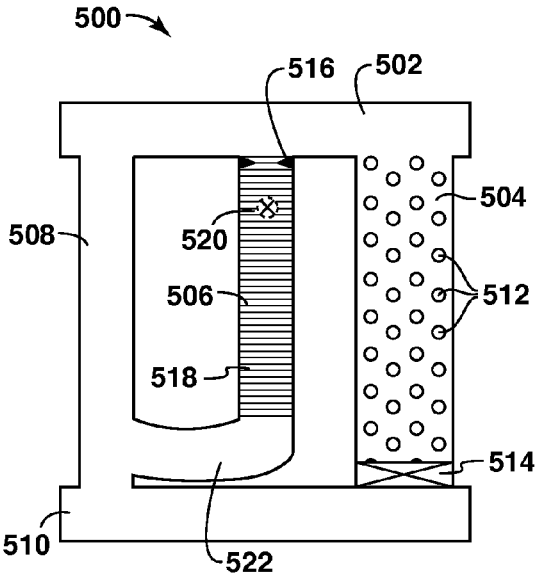
FIG. 7B is a schematic illustration of a tubular assembly adapted for use in providing a gravel-based zonal isolation system.
Figure 7C:
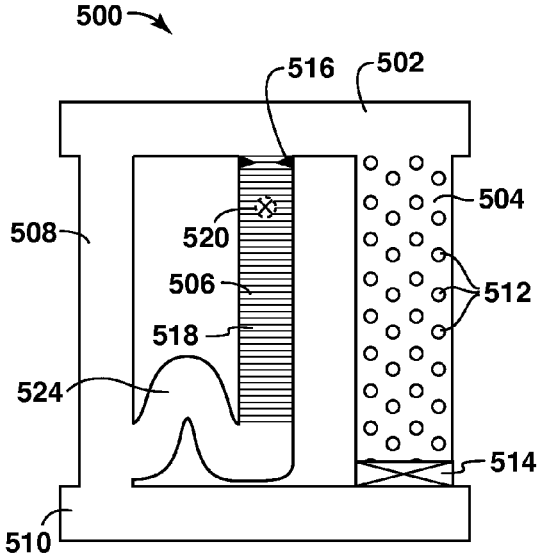
FIG. 7C is a schematic illustration of a tubular assembly adapted for use in providing a gravel-based zonal isolation system.
Figure 8:
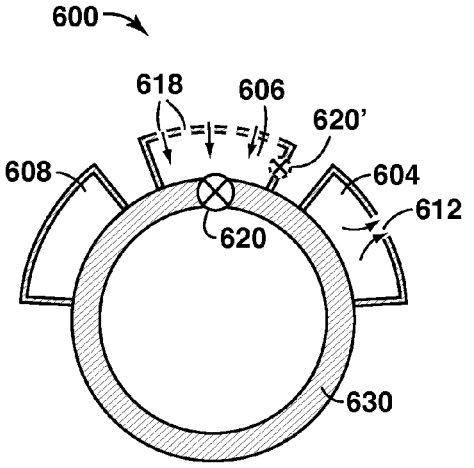
FIG. 8 is a schematic cross-sectional view of a tubular assembly operatively associated with a basepipe and adapted for use in providing a gravel-based zonal isolation system.
Figure 9:
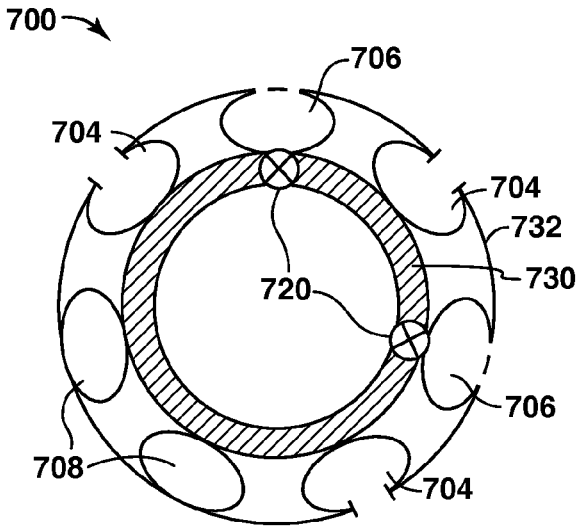
FIG. 9 is a schematic cross-section view of a tubular assembly operatively associated with a basepipe for use in providing a gravel-based zonal isolation system.

FIGS. 7A-7C provide various schematic side-view illustrations of exemplary tubular assemblies of the present technologies and will be discussed in turn. Each of FIGS. 7A-7C illustrate a tubular assembly 500 comprising an upstream manifold 502, a gravel packing conduit 504, a leak-off conduit 506, a transport conduit 508, and a downstream flow path 510. FIGS. 8 and 9 illustrate two examples of end-views of tubular assemblies associated with a base-pipe such as may be done according to the present technologies. FIGS. 10-13 provide schematic illustrations of a tubular assembly 500 disposed in a well at various stages during the formation of a gravel-based zonal isolation system. The description of one or more of these Figures may refer to another Figure for reference or further clarity. It should be understood that each of the tubular assemblies of FIGS. 7A-7C could be embodied in either of the manners illustrated in FIGS. 8 and 9, or in other suitable manners. Moreover, any of the configurations illustrated in FIGS. 7A-7C, 8, and 9, or other suitable configurations, may be implemented in the well as illustrated in FIGS. 10-13.

Using FIG. 7A as an exemplary configuration, the upstream manifold 502 of the tubular assembly 500 may be of any suitable configuration adapted to receive a gravel-laden slurry. The configuration of a given implementation may depend on a variety of factors, including the configuration of adjacent components of the tubing string and the intended operations on the well. For example, in implementations where the gravel-laden slurry will be flowing through the annulus when arriving at the location of the upstream manifold 502, the upstream manifold may be configured to receive the gravel-laden slurry from the annulus. In other implementations, the upstream manifold may be suitably configured to receive gravel-laden slurry from one or more flow conduits, such as shunt tubes, base pipe, etc.

As illustrated in FIG. 7A, at least three flow conduits extend away from the upstream manifold 502 in fluid communication with the upstream manifold. The gravel packing conduit 504 extends longitudinally away from the upstream manifold and is adapted to be in fluid communication with the upstream manifold 502 and with the annulus between a wellbore wall and the gravel packing conduit 504, when the tubular assembly is disposed in a well. FIG. 7A schematically illustrates the fluid communication with the annulus as relatively large openings in the sidewalls of the gravel-packing conduit 504. The gravel packing conduit 504 may be configured in any suitable manner to allow fluid communication of gravel-laden slurry from inside the gravel packing conduit to the annulus. In this respect at least, the gravel packing conduit 504 may be configured in manners similar to the variety of shunt tubes used in alternative gravel packing technologies, such as those referred to above. For the sake of convenience herein, the various means that may be used to provide the fluid communication of the gravel-laden slurry will be referred to as ports 512. The ports may comprise valves, openings, slots, perforations, etc. adapted to allow flow from within the gravel packing conduit 504 to the annulus. In some implementations, the ports 512 may be adapted to provide one directional flow, such as from within the gravel pack conduit 504 through the port to the annulus. Additionally or alternatively, some implementations may be provided with one or more features on the ports 512 to render flow in one direction preferred. As one example, the ports 512 may be equipped with swelling material adapted to swell when contacted by certain downhole fluids, to limit or shut-off flow through the ports 512.

FIG. 7A illustrates still further that the gravel packing conduit 504 is at least substantially isolated from direct fluid communication with a downstream flow path 510. The downstream flow path 510 is representative of one or more flow conduits that may exist downstream of the tubular assembly 500 other than the annulus. In some implementations, the downstream flow path 510 may be provided by the upstream manifold of a subsequent tubular assembly. The gravel packing conduit 504 is in direct fluid communication with the annulus through the ports 512 and, therefore, is in communication with the annulus both upstream and downstream of the tubular assembly. However, as schematically represented by barrier 514, the gravel packing conduit 504 is not in fluid communication with the downstream flow path 510, at least not directly. As will be understood from the description herein, the fluids exiting the gravel packing conduit 504 are able to pass into the leak-off conduit 506, which is in fluid communication with the downstream flow path 510. However, this indirect fluid communication is consistent with the design and intent of the present technologies. The lack of direct fluid communication with downstream flow paths 510 promotes the formation of a gravel pack at the location of the tubular assembly and the formation of a gravel-based zonal isolation system.

With continuing reference to FIG. 7A, the tubular assembly 500 further includes a leak-off conduit 506 and a transport conduit 508, each of which are in fluid communication with the upstream manifold 502. In some implementations, as illustrated schematically in FIG. 7A by the varying widths of the conduits, the tubular assembly 500 may be configured to encourage flow of the gravel-laden slurry from the upstream manifold into the gravel packing conduit 504 rather than the remaining conduits. In some implementations it may be preferred to promote gravel-laden slurry flow into the gravel pack conduit 504 rather than the transport conduit 508, for example, so as to form the gravel-based zonal isolation system in a more timely and efficient manner. Additionally, such a configuration may promote a more complete gravel pack in the annular region of the gravel-based zonal isolation system. In some implementations, it may be preferred that at least a majority of the gravel-laden slurry is directed to the gravel packing conduit 504 when beginning the gravel packing operation around the tubular assembly. As will be better understood with reference to FIGS. 10-13 below, the proportion of the gravel-laden slurry flowing to the gravel packing conduit will vary over time as the annulus becomes more gravel packed.

While flow to the gravel packing conduit 504 may be promoted merely by the relative sizes of the conduits and/or the number of conduits, one or more of the conduits, such as the transport conduit 508 and/or the leak-off conduit 506, may include flow control devices at the fluidic intersection with the upstream manifold. For example, the leak-off conduit 506 is illustrated in FIG. 7A as including a flow restrictor 516 at the intersection with the upstream manifold 502. The flow restrictor 516 may be configured in any suitable manner, including the use of valves, orifices, nozzles, etc. The degree to which the gravel-laden slurry is preferentially flowed to the gravel packing conduit 504 may vary in different implementations depending on the nature of the well, the nature of the formation, the position of the tubular assembly in the well, and other factors. In some implementations, the flow restrictor 516 on the leak-off conduit 506 may additionally function to promote leak-off from the annulus, as described below.

As mentioned above, FIG. 7A further illustrates, schematically, a leak-off conduit 506 fluidically coupled to the upstream manifold 502. As illustrated, the leak-off conduit 506 is in restricted fluid communication with the upstream manifold limiting the amount of gravel-laden slurry that can enter the leak-off conduit 506 from the upstream manifold 502. The leak-off conduit 506 is in fluid communication with the annulus through permeable media 518 adapted to retain particles while communicating fluids from the annulus to the interior of the leak-off conduit. Additionally, the leak-off conduit 506 is in fluid communication with the downstream flow paths. The restricted flow on the upstream side and the open flow on the downstream side of the leak-off conduit may function to maintain the fluid pressure in the leak-off conduit to below the fluid pressure in the annulus and the pressure in the gravel packing conduit when the annulus is being gravel packed. Accordingly, the leak-off conduit 506 is adapted to provide fluid leak-off from the annulus while gravel is being packed into the annulus to form the gravel-based zonal isolation system. As described above, the fluid leak-off available through the leak-off conduit 506 allows the gravel-based zonal isolation system to be positioned at virtually any location in the well, to be configured in a variety of lengths, to be utilized in series, etc.

The leak-off conduit 506 may be configured in any suitable manner to provide a permeable media 518 to retain particles while passing fluids, which may also be referred to as filtrate fluids. For example, the wall material providing the leak-off conduit may be slotted, may be perforated, or may otherwise include openings sized to retain the particles of the gravel-laden slurry while allowing fluids to enter. In some implementations, the leak-off conduit 506 may be configured with conventional sand control equipment, such as wire-wrap screens, etc. FIG. 7A additionally illustrates that the leak-off conduit 506 is provided with a flow control valve 520. The flow control valve 520 of FIG. 7A is illustrated as being positioned on the 'underside' of the tubular assembly. The functionality, utility, and configuration features of the flow control valve 520 will be described more fully in connection with Figures below.

As illustrated, the leak-off conduit 506 is in fluid communication with both the annulus (through the permeable media 518) and with the downstream flow path 510. Accordingly, fluid entering the leak-off conduit 506 from the annulus is allowed to flow to the downstream conduit 510 for mixing with the gravel-laden slurry flowing through the transport conduit 508 and for use with other operations further downstream in the well. In general, the leak-off conduit is in fluid communication with the downstream flow path 510 in a region longitudinally spaced from the upstream manifold 502. The schematic illustration of FIG. 7A illustrates the leak-off conduit 506 flowing directly into the schematic block representing downstream flow paths. The manner in which the leak-off conduit 506 connects, or fluidically couples, to the downstream flow path 510 may depend on a variety of factors and any suitable coupling configuration is within the scope of the present technologies. FIGS. 7B and 7C illustrate exemplary configurations; additional configurations providing fluid communication between the downstream flow path 510 and the leak-off conduit 506 are within the scope of the present technologies.

FIG. 7A additionally illustrates that the tubular assembly 500 includes a transport conduit 508 extending between the upstream manifold 502 and the downstream flow path 510 and providing fluid communication therebetween. The transport conduit 508 provides fluid communication for the gravel-laden slurry through the tubular assembly 500 so that the transported gravel-laden slurry can be used in other downstream operations, such as gravel packing and/or the formation of additional gravel-based zonal isolation systems. As can be understood by one of ordinary skill in the art, the transport conduit 508 may be configured similar to transport conduits utilized in conventional alternate path technologies. As described above, the transport conduit 508 may be configured to influence the distribution of gravel-laden slurry from the upstream manifold 502, such as to preferentially flow to the gravel packing conduit 504.

FIGS. 7B and 7C provide schematic illustrations of alternative couplings and relationships between the leak-off conduit 506, the transport conduit 508, and the downstream flow path 510. As illustrated in FIG. 7B, the leak-off conduit 506 is in fluid communication with the transport conduit 508 in a region longitudinally offset from the upstream manifold and is then in communication with the downstream flow path via the transport conduit. The manner of connecting the leak-off conduit 506 with the transport conduit 508 is illustrated as a simple J-shaped bend 522 in the leak-off conduit. Any suitable manipulation of the leak-off conduit and/or the transport conduit to provide fluid communication between the leak-off conduit and the downstream flow path may be used.

For example, FIG. 7C illustrates that the leak-off conduit 506 and the transport conduit 508 may be connected by a double-U-shaped connector 524. As described herein, the methods of the present technology include gravel packing the leak-off conduit 506 to form the gravel-based zonal isolation system. In the event that the tubular assembly 500 of FIG. 7A is installed in a vertical well, the gravel pack in the leak-off conduit 506 may be inclined to fall into the downstream flow path or to other spaces depending on the pressure maintained in the tubular assembly. In implementations such as those shown in FIG. 7C, where a double-U-shaped connector is implemented, the configuration of the connector may operate to retain the gravel in the desired position regardless of the pressure changes downstream. The double-U-shaped connector 524 is just one example of a suitable connector configuration where the connection between the leak-off conduit 506 and the downstream flow path 510 is selected to retain the gravel in the leak-off conduit after formation of the gravel-based zonal isolation system. Any such suitable configuration may be used in the present technologies.

FIGS. 8 and 9 provide schematic end-views of tubular assemblies operatively associated with basepipes. Specifically, FIG. 8 illustrates a tubular assembly 600 associated as external shunt tubes on the periphery of a basepipe 630. FIG. 9 illustrates a tubular assembly 700 associated with a basepipe 730 and associated as a plurality of internal tubes concentrically disposed around the basepipe. Other configurations and associations are available and within the scope of the present technologies; these are illustrated as examples only. Beginning with FIG. 8, it can be seen that the tubular assembly 600 is illustrated here to further highlight the relationship between the various conduits. Similar to the configuration illustrated in FIG. 7A, the tubular assembly 600 includes a gravel packing conduit 604, a leak-off conduit 606, and a transport conduit 608, each disposed on the exterior of the basepipe 630. The gravel packing conduit 604, as described above, includes ports 612 to communicate fluid to the annulus. Similarly, the transport conduit 608 is as described above, being configured to transport fluids longitudinally. The leak-off conduit 606, while functionally the same as described in connection with FIG. 7A, is illustrated here in a manner to facilitate further discussion of its functionality.

As described above, the leak-off conduit 606 is configured with semi-permeable media 618 providing fluid communication between the annulus (outside of the tubular assembly 600) and the interior of the leak-off conduit. The permeable media is schematically represented here and may be provided in any of the configurations or implementations described above. FIG. 8 further illustrates a better perspective of the flow control valve 620. As described above, the leak-off conduit 606 is gravel packed through the process of forming a gravel-based zonal isolation system, which requires the dehydration of a gravel-laden slurry in the leak-off conduit. As can be understood from the description herein, the gravel-packing of the leak-off conduit 606 does not begin until the annulus has been gravel packed, which may limit the ability of slurry in the leak-off conduit 606 to dehydrate to the annulus. Additionally or alternatively, in some implementations the permeable media 618 may be configured to only allow flow in one direction (e.g., into the leak-off conduit to dehydrate the annulus). In either circumstance, the leak-off conduit would not be able to dehydrate and a gravel pack would not form in the leak-off conduit.

The flow control valve 620 illustrated in FIG. 8 provides controlled fluid communication between the leak-off conduit and the interior of the basepipe. FIG. 8 further illustrates a flow control valve 620' optionally disposed on the sidewall of the leak-off conduit. The flow control valve 620 may be disposed in any suitable location in the leak-off conduit to provide a flow path to dehydrate the leak-off conduit when it is being gravel packed. Flow control valves 620 may be distributed longitudinally and/or circumferentially. Additional implementations may provide fluid communication between the leak-off conduit 606 and the transport conduit 608, such as in a region closer to the upstream manifold, between the leak-off conduit and the upstream manifold, or between the leak-off conduit and any other flow path that will allow the leak-off conduit to be dehydrated when it is being gravel packed. In some implementations, the flow control valve 620 may be configured to allow flow in only one direction, only under certain pressure conditions, or under otherwise controlled circumstances. Additionally or alternatively, the flow control valve 620 may be adapted to be opened and/or closed at predetermined times and/or under predetermined conditions. For example, the flow control valve 620 may be configured with swellable or otherwise responsive material that closes the valve during production operations, such as by responding to the presence of hydrocarbons or other fluids. Additionally or alternatively, the flow control valve 620 and/or the flow control valve and cooperating components may be adapted to limit the flow of gravel or other particulates through the flow control valve 620, thereby encouraging the gravel packing of the leak-off conduit and limiting the valve to its dehydration objective. Exemplary implementations may include the use of screens, mesh, perforations, etc. to retain particles while passing fluids. As can be understood from this description of the flow control valve 620, the flow control valve may be configured in any suitable manner and disposed in any suitable relationship to the remaining elements of the tubular assembly such that the flow control valve 620 assists in the dehydration of the gravel-laden slurry flowing into the leak-off conduit when gravel packing the leak-off conduit in the formation of a gravel-based zonal isolation system. Notably, tubular assemblies within the scope of the present disclosure may comprise one or more than one flow control valves associated with the leak-off conduit.

FIG. 9, like FIG. 8, illustrates an end-view of a tubular assembly 700 associated with a basepipe 730. As can be seen in FIG. 9, the tubular assembly 700 is configured as a plurality of concentrically-disposed conduits associated with the basepipe 730. As illustrated, the conduits are spaced around the basepipe and within an outer shroud or liner 732. Some gravel packing operations in use today utilize internal shunts and conduits, referring to the shunts and conduits being internal to a screen or other component of the tubing string. Other gravel packing operations utilize external shunts, or shunts disposed outside of the sand control screen. FIGS. 8 and 9 together illustrate that the tubular assemblies of the present technologies are compatible with alternate path gravel packing and the associated sand control equipment.

FIG. 9 schematically illustrates a tubular assembly 700 having a plurality of each of the conduits illustrated in FIG. 7A, including two transport conduits 708, two leak-off conduits 706, and three gravel packing conduits 704 having the features described above. The sizing, number, placement, etc. of the flow control conduits may be selected depending on the location within the well at which the tubular assembly will be disposed (such as the relative need for transport conduits), the need for leak-off conduits (such as the relative permeability of the formation in different implementations), the relative sizes of the well, the basepipe, and the various conduits, etc. FIG. 9 further illustrates that the plurality of conduits may be enclosed within an outer shroud 732. The outer shroud 732 may be of uniform configuration, such as a configuration adapted to not interfere with the functionality of the underlying conduits. Additionally or alternatively, the outer shroud 732 may be adapted according to the functionality of the underlying conduit, such as with ports adjacent to the gravel packing conduits 704 and with perforations or slits adjacent to the leak-off conduits 706.

FIGS. 7A-7C, 8, and 9 should be viewed collectively as exemplary configurations to illustrate the diversity of configuration and implementation options that may be varied and selected in constructing a tubular assembly appropriate or suitable for its intended use. The present technologies include all tubular assembly configurations within the scope of the appended claims.

Figure 10:
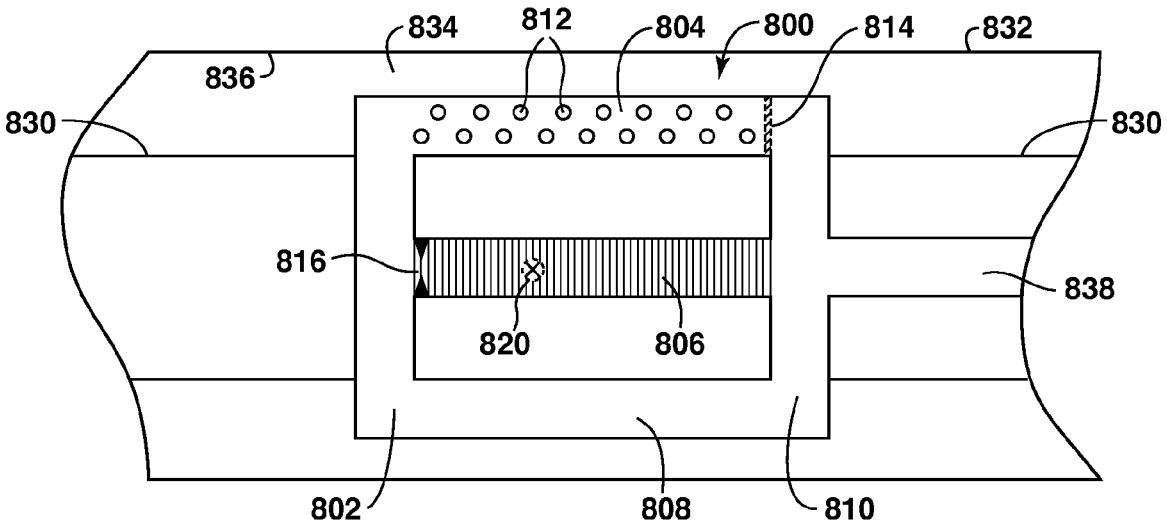
FIG. 10 is a schematic view of tubular assembly operatively associated with a basepipe and disposed in a well.

FIGS. 10-13 provide schematic side-views of a tubular assembly 800 associated with a tubing string, such as a base pipe 830, and disposed in a well 832. FIG. 10 provides a basic side-view before isolation forming operations have begun and FIGS. 11-13 progress through an exemplary illustration of a process for forming a gravel-based zonal isolation system. As used herein, the methods and steps associated with using the presently described tubular assemblies to form a gravel-based zonal isolation system are referred to as isolation forming operations. It should be understood from the description herein that the present tubular assemblies and operations enable the isolation forming operations to be conducted as part of a gravel packing operation or as a stand-alone operation. Base pipe 830 is representative of the various downhole equipment that may be coupled to the tubular assembly 800. For example, the tubular assembly may be coupled to any component commonly used in a tubing string, such as annular coiled tubing, a production tubing basepipe, sand control equipment, gravel pack equipment, etc. FIG. 10 illustrates the tubular assembly 800 disposed in a well 832 forming an annulus 834 between the wellbore wall 836 and the tubular assembly. In the exemplary illustration of FIGS. 10-13, the upstream manifold 802 receives gravel-laden slurry from the annulus 834 and transfers the same to the various conduits of the tubular assembly 800. The gravel packing conduit 804 is represented in a manner similar to the representation of FIG. 7A. In addition to the ports 812 of the gravel packing conduit 804, FIG. 10 illustrates the barrier 814 disposed at the longitudinally distal end of the gravel packing conduit preventing, or at least substantially preventing fluid communication with the downstream flow path 810. As with FIG. 7A, the downstream flow path 810 is illustrated schematically to represent the plurality of downstream configurations with which the present tubular assemblies 800 may be associated. For simplicity in description, the schematic illustrations of FIGS. 10-13 illustrate the downstream flow path 810 as a manifold on the downstream side to receive flow from the leak-off conduit 806 and the transport conduit 808 and flowing into a shunt tube 838 on the downstream side. The shunt tube 838 may be configured to carry the gravel-laden slurry further into the well to gravel pack more distal regions of the well. Additionally or alternatively, some implementations may fluidically connect the downstream flow path 810 with a subsequent upstream manifold commencing another tubular assembly according to the present technologies.

Figure 11:
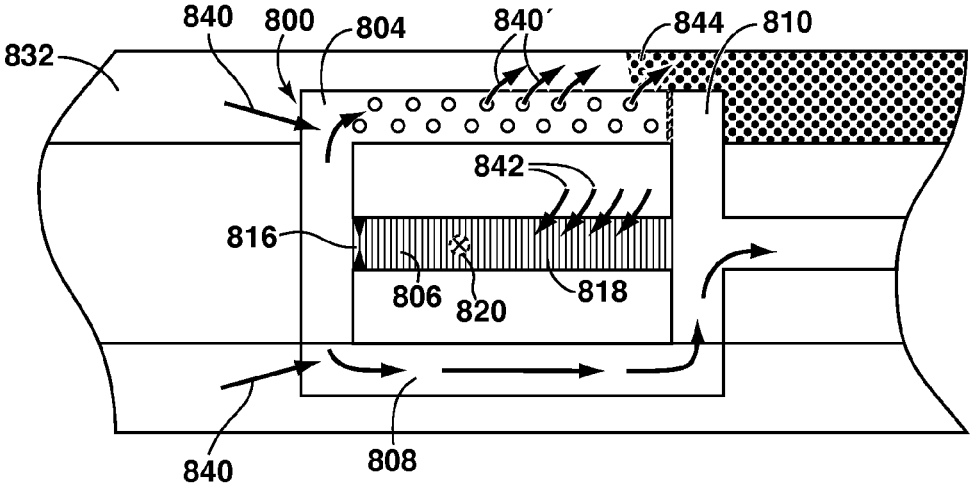
FIG. 11 is a schematic view of the tubular assembly of FIG. 10 illustrating a stage in the formation of a gravel-based zonal isolation system.

Continuing now with FIG. 11, the tubular assembly 800 and well 832 of FIG. 10 are illustrated after gravel-laden slurry, represented by arrows 840, has been flowing into the upstream manifold for a time. The gravel-laden slurry 840 may enter the upstream manifold, rather than flowing through the annulus, for a variety of reasons, which are well understood by those in the industry. In some implementations, the present tubular assemblies 800 are adapted to function in a manner similar to conventional alternate path gravel packing tools to divert the gravel-laden slurry around premature sand bridges. In such implementations, the upstream manifold 802 may receive gravel-laden slurry according to conventional alternate path gravel packing operations when a sand bridge or an annular packer prevents packing the annulus around the tubular assembly 800. In some implementations, the upstream manifold may be longitudinally spaced from the conduits of the tubular assembly, such as in connection with other alternate path technologies. Additionally or alternatively, the upstream manifold 802 may be disposed adjacent or proximate to the conduits of the tubular assembly providing some alternate path functionality to allow gravel-laden slurry through the tubular assembly, such as through the transport conduit, and through the forming gravel-based zonal isolation system.

Once the tubular assembly 800 is disposed in the well, the gravel-laden slurry is pumped into the annulus to commence a gravel packing operation, which may be conventional, alternate path, or any other suitable form of gravel packing operation. Some of the gravel-laden slurry enters the upstream manifold, such as described above, and is diverted by the manifold into one of three conduit types, the gravel packing conduit 804, the leak-off conduit 806, and the transport conduit 808. In the absence of a gravel pack building downstream of the tubular assembly, such as by progression of the gravel pack operation and/or by the formation of a sand bridge, the gravel-laden slurry exiting the gravel packing conduit 804 flows into the annulus 834 and proceeds downstream to gravel pack the well in a manner similar to conventional alternate path gravel packing operations. As the building gravel pack approaches the tubular assembly 800, as illustrated in FIG. 11, the gravel-laden slurry 840' exiting the gravel packing conduit 804 begins to accumulate in the annulus adjacent the tubular assembly. The fluids in the gravel-laden slurry 840' are directed to the leak-off conduit 806, at least in part because of the lack of inlets to the base pipe as compared to the remaining lengths of the tubing string. The permeable media 818 permits the fluids to pass through as filtrate 842 into the leak-off conduit 806, which filtrate flows to the downstream flow path 810 (and/or the transport conduit, as described above). The dehydration of the gravel-laden slurry 840' results in the formation of a gravel pack 844 adjacent the gravel packing conduit and the leak-off conduit.

Figure 12:
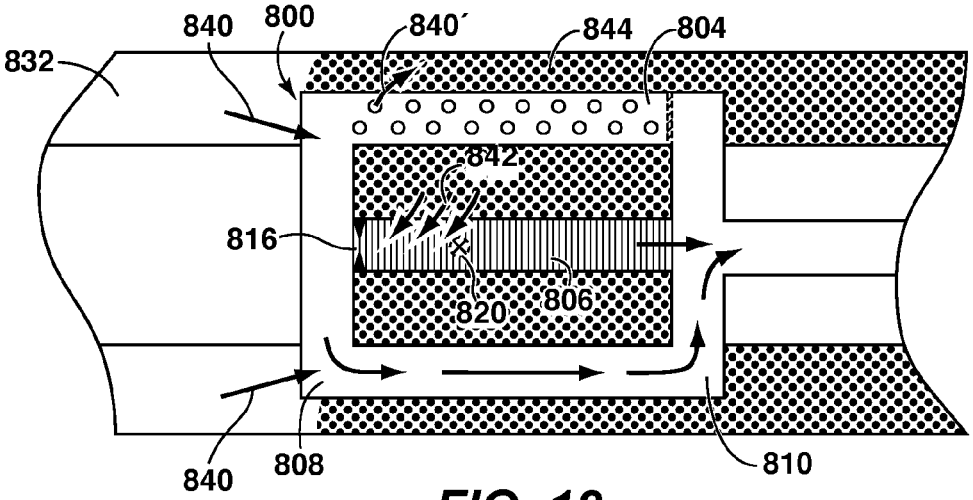
FIG. 12 is a schematic view similar to FIG. 11 and illustrating a further stage in the formation of a gravel-based zonal isolation system.

This gravel packing operation continues with more and more of the gravel-laden slurry being diverted to the transport conduit than the gravel packing conduit as the annulus adjacent the gravel packing conduit becomes more gravel packed. As illustrated in FIG. 12, there comes a time when very little gravel-laden slurry 840' is exiting the gravel packing conduit 804 (schematically represented by the presence of a substantially complete gravel pack and a single flow arrow 840') and the volume of filtrate 842 entering the leak-off conduit from the annulus is minimal. In some implementations, the annulus around the gravel packing conduit 804 will become gravel packed before the remainder of the wellbore, or a more distal region of the wellbore, is gravel packed. In such implementations, the gravel-laden slurry 840 received by the upstream manifold 802 will be diverted to the transport conduit 808 and/or the leak-off conduit 806 and to the downstream flow paths 810 to gravel pack the downstream regions of the well. As discussed above, the flow restrictor 816 will allow some of the gravel-laden slurry therethrough but restricts the flow to limit pressure in the leak-off conduit from the upstream manifold. It will be understood that very little of the gravel-laden slurry will dehydrate in the stage illustrated in FIG. 12 to form a gravel pack in the leak-off conduit due to the flow resistance imposed by the packed annulus and by the flow control valve 820. Accordingly, fluid, including filtrate 842 and gravel-laden slurry 840, entering the leak-off conduit 806 will flow to the lower-pressure, downstream flow paths 810 rather than packing in the leak-off conduit.

Figure 13:
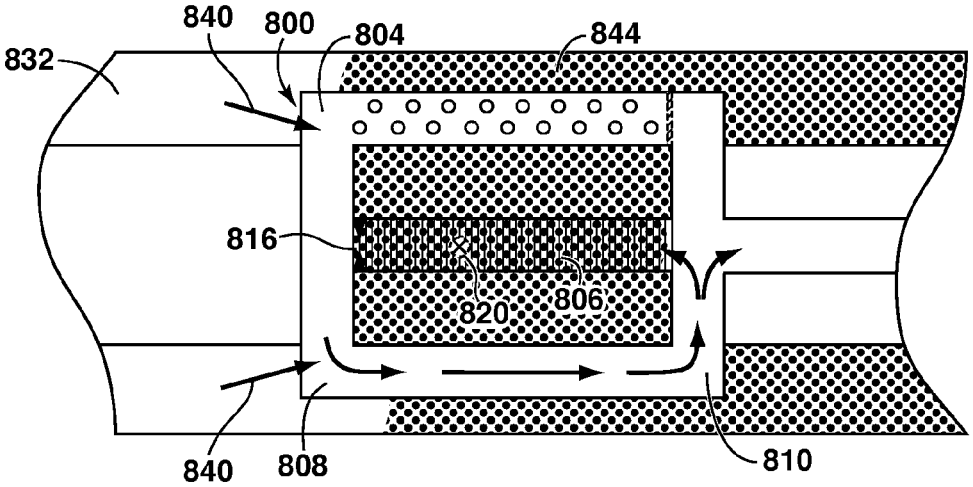
FIG. 13 is a schematic view similar to FIG. 12 and illustrating a further stage in the formation of a gravel-based zonal isolation system.

FIG. 13 illustrates that when the downstream regions of the well are sufficiently gravel packed, the pressure of the gravel-laden slurry in the downstream flow path 810, the transport conduit, and the leak-off conduit increases. The increased pressure causes the gravel-laden slurry to flow into the leak-off conduit 806 from the transport conduit and increasingly from the upstream manifold through the flow restrictor 816. As the pressure builds in the leak-off conduit, the fluids in the gravel-laden slurry will be driven to lower pressure regions, which may be found in the annulus back through the permeable media 818 and/or through one or more flow control valves 820. The resulting gravel pack in the leak-off conduit 806 is illustrated in FIG. 13. In order to limit the ability of the leak-off conduit forming a gravel pack before the annulus is sufficiently gravel packed, the flow control valve 820 may be configured to only allow flow from the leak-off conduit when the pressure differential across the valve exceeds a predetermined level, such as when the flow control valve 820 provides fluid communication between the leak-off conduit and the interior of the basepipe 830. As described above, the flow control valve 820, alone or together with supporting equipment, may be adapted to prevent, or substantially prevent, particulate matter, such as gravel, from flowing through the valve.

The flow restriction provided by the flow restrictor 816 and the flow control valve 820 may be varied and selected depending on the specifics of a given implementation. For example, depending on where in the tubing string the tubular assembly 800 will be disposed, where the flow control valve 820 communicates the fluids from the leak-off conduit, etc. Similarly, the number and spacing and positions of the ports 812, the configuration of the permeable media 818, and the configuration, number, position, etc. of the flow control valve 820 may vary to provide greater control over the gravel packing operations. In some implementations, the elements may be configured such that the annular region 834 is further packed during the time that the leak-off conduit is being gravel packed, such as with fluid from the upstream manifold 802. For example, as the pressure continues to build within the tubular assembly 800, the pressure may drive more gravel-laden slurry 840' into the annulus through the gravel packing conduit 804.

After the gravel pack forms in the leak-off conduit 820, the gravel-based zonal isolation system is formed, comprising the annular gravel pack adjacent the gravel packing conduit and the gravel pack in the leak-off conduit. As described above, the length of the gravel pack in the annulus and the leak-off conduit can be adjusted to vary the integrity or quality of the zonal isolation as desired by the specific implementation and as appropriate for the formation conditions. In some implementations, the degree of isolation desired may be accomplished using a single tubular assembly 800 and other implementations may utilize two or more tubular assemblies in series. In some implementations, the two or more tubular assemblies may be disposed immediately adjacent to each other in the tubing string. Advantageously, the isolation forming operations described in connection with FIGS. 10-13 can be conducted during gravel packing operations, reducing the number of distinct operations run on a well before production begins and providing numerous benefits associated therewith.

In some implementations, the desired length of the gravel-based zonal isolation system, such as to accomplish the desired zonal isolation, may range from about 5 feet to about 200 feet, or longer. The only limit on the length of the gravel-based zonal isolation system is the practical realities of the well, such as the costs of the operations. A single tubular assembly as described herein may have a length between about 5 feet and about 80 feet, and perhaps more commonly 40 feet, or the length of common tubing string joint. However, the ability to connect multiple tubular assemblies in series allows gravel-based zonal isolation systems of any practical length.

Still additionally, the tubular assemblies and methods of the present disclosure may be used in combination with a packer, as first described in connection with FIG. 4. The combination of the gravel-based zonal isolation system and the conventional packer may relax the requirements of the packer and/or provide a secondary barrier in the event of failure of the packer.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A tubular assembly adapted for downhole use in wells, the tubular assembly comprising:

an upstream manifold adapted to receive a gravel-laden slurry;

a gravel packing conduit in fluid communication with the upstream manifold and extending longitudinally away from the upstream manifold; wherein the gravel packing conduit is adapted to receive at least a portion of the gravel-laden slurry including both fluid and gravel simultaneously from the upstream manifold; wherein the gravel packing conduit is adapted to be in simultaneous fluid and gravel communication with an annulus between a wellbore wall and the tubular assembly when the tubular assembly is disposed downhole in a well; wherein the gravel packing conduit is adapted to communicate gravel-laden slurry into the annulus during isolation forming operations; and wherein the gravel packing conduit is at least substantially isolated from direct fluid communication with a downstream flow path;

a transport conduit in fluid communication with the upstream manifold and in simultaneous fluid and gravel communication with the downstream flow path; and a leak-off conduit; wherein the leak-off conduit is in at least partially restricted gravel-laden slurry communication with the upstream manifold; wherein the leak-off conduit is in simultaneous fluid and gravel communication with the downstream flow path in a region longitudinally spaced from the upstream manifold; and wherein the leak-off conduit is in fluid communication with the annulus through permeable media adapted to retain particles while communicating fluids providing fluid leak-off from the annulus during the isolation forming operations.

2. The tubular assembly of claim 1 wherein the gravel packing conduit includes at least one flow path adapted to gravel pack an interval of the wellbore.

3. The tubular assembly of claim 1 wherein the at least partially restricted fluid communication between the upstream manifold and the leak-off conduit and the fluid communication between the leak-off conduit and the downstream flow path maintains fluid pressure in the leak-off conduit below a pressure in the annulus and a pressure in the gravel packing conduit during at least a portion of the isolation forming operations.

4. The tubular assembly of claim 3 wherein fluid pressure in the leak-off conduit increases as isolation forming operations progress.

5. The tubular assembly of claim 4 wherein gravel-laden slurry enters the leak-off conduit from at least one of the downstream flow path and the transport conduit as isolation forming operations progress.

6. The tubular assembly of claim 5 wherein fluid in the gravel-laden slurry in the leak-off conduit exits the leak-off conduit into at least one of the annulus and a basepipe associated with the tubular assembly thereby gravel packing the leak-off conduit.

7. The tubular assembly of claim 6 wherein the fluid exits the leak-off conduit through at least one flow control valve.

8. The tubular assembly of claim 6 wherein the gravel packed leak-off conduit and the gravel-packed annulus together provide a zonal isolation assembly in the wellbore.

9. The tubular assembly of claim 1 wherein the leak-off conduit and the gravel packing conduit are adapted to provide a zonal isolation assembly in the wellbore in a region adjacent the tubular assembly.

10. The tubular assembly of claim 9 wherein the zonal isolation assembly is adapted to at least substantially isolate annular intervals on either side of the tubular assembly.

11. The tubular assembly of claim 9 wherein the zonal isolation assembly is formed during gravel packing operations.

12. The tubular assembly of claim 1 wherein at least one of the gravel packing conduit, the transport conduit, and the leak-off conduit is operatively associated with a base pipe.

13. The tubular assembly of claim 1 wherein at least one of the upstream manifold, the transport conduit, the leak-off conduit, and the gravel packing conduit are adapted to promote fluid flow from the upstream manifold into the gravel packing conduit.

14. The tubular assembly of claim 1 wherein the fluid communication between the leak-off conduit and the downstream flow path is through a double-U assembly.

15. A method for providing a gravel-based zonal isolation system in a hydrocarbon-related well, the method comprising:

providing a tubular assembly comprising:

an upstream manifold;

a gravel packing conduit in fluid communication with the upstream manifold and extending longitudinally away from the upstream manifold; wherein the gravel packing conduit is adapted to receive at least a portion of the gravel-laden slurry including both fluid and gravel simultaneously from the upstream manifold; wherein the gravel packing conduit is adapted to be in simultaneous fluid and gravel communication with an annulus between a wellbore wall and the tubular assembly; and wherein the gravel packing conduit is at least substantially isolated from direct fluid communication with a downstream flow path;

a transport conduit in fluid communication with the upstream manifold and in simultaneous fluid and gravel communication with the downstream flow path; and a leak-off conduit; wherein the leak-off conduit is in at least partially restricted fluid communication with the upstream manifold; wherein the leak-off conduit is in fluid and slurry communication with the downstream flow path in a region longitudinally spaced from the upstream manifold; and wherein the leak-off conduit is in fluid communication with the annulus through permeable media adapted to retain particles while communicating filtrate fluids providing fluid leak-off from the annulus during isolation forming operations;

positioning the tubular assembly at a predetermined position within a well;

pumping gravel-laden slurry to the upstream manifold;

flowing at least a portion of the gravel-laden slurry to the gravel packing conduit to gravel pack an annulus between the tubular assembly and a wellbore wall;

dehydrating the gravel pack in the annulus through at least the permeable media of the leak-off conduit; wherein the filtrate through the permeable media flows through the leak-off conduit to the downstream flow path; and gravel packing the leak-off conduit with gravel laden slurry from at least one of the upstream manifold, the downstream flow path, and the transport conduit; wherein the leak-off conduit gravel pack is dehydrated to at least one of the annulus and a basepipe associated with the tubular assembly; and wherein the leak-off conduit gravel pack and the annular gravel pack are adapted to provide a zonal isolation system.

16. The method of claim 15 wherein the tubular assembly is coupled to downhole equipment when positioned at a predetermined position within the well.

17. The method of claim 16 wherein the downhole equipment comprises one or more equipment selected from annular coiled tubing, production tubing basepipe, sand control equipment, and gravel pack equipment.

18. The method of claim 15 wherein flowing at least a portion of the gravel-laden slurry to the gravel packing conduit comprises flowing at least a majority of the gravel-laden slurry in the upstream manifold to the gravel-packing conduit.

19. The method of claim 15 wherein the gravel packing conduit comprises at least two gravel packing conduits in fluid communication with the upstream manifold and the annulus.

20. The method of claim 15 wherein the gravel packing conduit is in direct fluid communication with only the upstream manifold and the annulus.

21. The method of claim 15 wherein dehydrating the gravel pack in the annulus includes dehydrating fluids through the wellbore wall to a formation.

22. The method of claim 15 wherein the permeable media of the leak-off conduit comprises a plurality of openings.

23. The method of claim 22 wherein the leak-off conduit comprises a slotted tube.

24. The method of claim 22 wherein the leak-off conduit comprises a sand screen.

25. The method of claim 15 further comprising gravel packing distal regions of the well with gravel-laden slurry; wherein at least a portion of the gravel-laden slurry used to gravel pack distal regions of the well flowed through the transport conduit.

26. The method of claim 25 wherein gravel packing distal regions of the well utilizes at least one of non-shunted gravel packing technology and shunted gravel packing technology.

27. The method of claim 25 wherein gravel packing distal regions comprises providing at least one additional gravel-based zonal isolation assembly.

28. A method of operating a hydrocarbon-related well, the method comprising:

conducting gravel packing operations in a wellbore utilizing at least one sand screen;

forming a gravel-based zonal isolation system in the wellbore while conducting gravel packing operations wherein forming a gravel-based zonal isolation system utilizes a tubular assembly comprising;

(i) an upstream manifold;

(ii) a gravel packing conduit in fluid communication with the upstream manifold and extending longitudinally away from the upstream manifold; wherein the gravel packing conduit is adapted to receive a gravel-laden slurry including both the fluid and gravel simultaneously from the upstream manifold; wherein the gravel packing conduit is adapted to be in simultaneous fluid and gravel communication with an annulus between a wellbore wall and the tubular assembly when the tubular assembly is disposed downhole in a well; wherein the gravel packing conduit is adapted to communicate the gravel-laden slurry into the annulus during isolation forming operations; and wherein the gravel packing conduit is at least substantially isolated from direct fluid communication with a downstream flow path;

(iii) a transport conduit in fluid communication with the upstream manifold and in simultaneous fluid and gravel communication with the downstream flow path; and (iv) a leak-off conduit; wherein the leak-off conduit is in at least partially restricted fluid communication with the upstream manifold; wherein the leak-off conduit is in fluid and slurry communication with the downstream flow path in a region longitudinally spaced from the upstream manifold; and wherein the leak-off conduit is in fluid communication with the annulus through permeable media adapted to retain particles while communicating fluids providing fluid leak-off from the annulus during the isolation forming operations; and conducting at least one additional operation in the wellbore utilizing the gravel-based zonal isolation device.

29. The method of claim 28 wherein the gravel packing conduit comprises at least two gravel packing conduits in fluid communication with the upstream manifold and the annulus.

30. The method of claim 28 wherein the gravel packing conduit is in direct fluid communication with only the upstream manifold and the annulus.

31. The method of claim 28 wherein forming a gravel-based zonal isolation system further comprises:

positioning the tubular assembly at a predetermined position within a well;

pumping gravel-laden slurry to the upstream manifold;

flowing at least a portion of the gravel-laden slurry to the gravel packing conduit to gravel pack an annulus between the tubular assembly and a wellbore wall;

dehydrating the gravel pack in the annulus through at least the permeable media of the leak-off conduit; wherein filtrate through the permeable media flows through the leak-off conduit to the downstream flow path;

gravel packing the leak-off conduit with gravel laden slurry from at least one of the upstream manifold, the downstream flow path and the transport conduit; wherein the leak-off conduit gravel pack is dehydrated to at least one of the annulus and a basepipe associated with the tubular assembly; and wherein the leak-off conduit gravel pack and the annular gravel pack are adapted to provide a zonal isolation system.

32. The method of claim 31 wherein flowing at least a portion of the gravel-laden slurry to the gravel packing conduit comprises flow at least a majority of the gravel-laden slurry in the upstream manifold to the gravel-packing conduit.

33. The method of claim 31 wherein dehydrating the gravel pack in the annulus includes dehydrating fluids through the wellbore wall to a formation.

34. The method of claim 31 further comprising gravel packing distal regions of the well with gravel-laden slurry; wherein at least a portion of the gravel-laden slurry used to gravel pack distal regions of the well is flowed through the transport conduit.

35. The method of claim 34 wherein gravel packing distal regions of the well utilizes at least one of un-shunted and shunted gravel packing technology.

36. The method of claim 34 wherein gravel packing distal regions comprises providing at least one additional gravel-based zonal isolation assembly.

* * * * *